US010545446B2

(12) United States Patent
Takikawa et al.

(10) Patent No.: US 10,545,446 B2
(45) Date of Patent: Jan. 28, 2020

(54) TONE CORRECTION IMAGE PROCESSING BASED ON PIXEL FORMATION POSITION ON A PHOTORECEPTOR

(71) Applicant: CANON KABUSHIKI KAISHA, Tokyo (JP)

(72) Inventors: Yoichi Takikawa, Kawasaki (JP); Ryosuke Otani, Tokyo (JP); Hidenori Kanazawa, Mishima (JP); Go Araki, Suntou-gun (JP); Hisashi Ishikawa, Urayasu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 39 days.

(21) Appl. No.: 15/351,730

(22) Filed: Nov. 15, 2016

(65) Prior Publication Data

US 2017/0139363 A1 May 18, 2017

(30) Foreign Application Priority Data

Nov. 16, 2015 (JP) ..... 2015-224234

(51) Int. Cl.
*G03G 15/00* (2006.01)
*G03G 15/01* (2006.01)

(52) U.S. Cl.
CPC ..... *G03G 15/5062* (2013.01); *G03G 15/01* (2013.01)

(58) Field of Classification Search
CPC ..... G03G 15/5062; G03G 15/01; G03G 15/04072; G03G 15/043; G03G 2215/0164; G03G 2215/0129
See application file for complete search history.

(56) References Cited

U.S. PATENT DOCUMENTS 9,485,388 B2 11/2016 Kodama et al.
2013/0258035 A1* 10/2013 Hattori ..... B41J 2/47 347/248

(Continued)

FOREIGN PATENT DOCUMENTS

JP 2000190554 A 7/2000
JP 2006-349851 A 12/2006
JP 2010099931 A 5/2010

OTHER PUBLICATIONS

Japanese Office Action for application No. 2015224234 dated Jul. 12, 2019 with English translation.

*Primary Examiner* — Christopher Wait
(74) *Attorney, Agent, or Firm* — Carter, DeLuca & Farrell LLP

(57) ABSTRACT

The present invention performs inplane uneven density correction that suppresses a number of tone correction properties and has few correction residuals. Accordingly, a holding unit of an apparatus of the present invention holds a plurality of tone correction properties respectively corresponding to a plurality of spot diameters that divide a range of a spot diameter of a light exposed on a surface of a photoreceptor by a predetermined interval. In addition a setting unit sets a tone correction property selected from the plurality of tone correction properties based on a spot diameter on the photoreceptor for a pixel corresponding to pixel data C. A correction unit corrects the pixel data C based on the set tone correction property, to generate tone correction data Cc.

12 Claims, 22 Drawing Sheets

(56) References Cited

U.S. PATENT DOCUMENTS

| | | | |
|---|---|---|---|
| 2014/0355010 | A1 | 12/2014 | Hara et al. |
| 2014/0376056 | A1 | 12/2014 | Fujimoto et al. |
| 2016/0004942 | A1 | 1/2016 | Sumi et al. |
| 2016/0209773 | A1 | 7/2016 | Otani |
| 2017/0041502 | A1 | 2/2017 | Fuse et al. |
| 2017/0111547 | A1 | 4/2017 | Otani et al. |
| 2017/0111548 | A1 | 4/2017 | Yamamoto et al. |
| 2017/0139344 | A1 | 5/2017 | Takikawa et al. |
| 2017/0142290 | A1 | 5/2017 | Fuse et al. |

* cited by examiner

FIG. 6

| POSITION | SPOT DIAMETER |
|---|---|
| -128 | 100 |
| -127 | 99 |
| -126 | 98 |
| ⋮ | ⋮ |
| -2 | 71 |
| -1 | 70 |
| 0 | 70 |
| 1 | 70 |
| 2 | 71 |
| ⋮ | ⋮ |
| 125 | 97 |
| 126 | 98 |
| 127 | 99 |

| T70 | | T75 | | | T100 | |
|---|---|---|---|---|---|---|
| IN-PUT | OUT-PUT | IN-PUT | OUT-PUT | | IN-PUT | OUT-PUT |
| 0 | 0 | 0 | 0 | | 0 | 0 |
| 1 | 1 | 1 | 2 | | 1 | 3 |
| 2 | 2 | 2 | 3 | | 2 | 6 |
| ⋮ | ⋮ | ⋮ | ⋮ | | ⋮ | ⋮ |
| 63 | 63 | 63 | 63 | | 63 | 64 |
| 64 | 64 | 64 | 64 | … | 64 | 64 |
| 65 | 65 | 65 | 64 | | 65 | 64 |
| ⋮ | ⋮ | ⋮ | ⋮ | | ⋮ | ⋮ |
| 125 | 125 | 125 | 123 | | 125 | 121 |
| 126 | 126 | 126 | 125 | | 126 | 124 |
| 127 | 127 | 127 | 127 | | 127 | 127 |

FIG. 13A
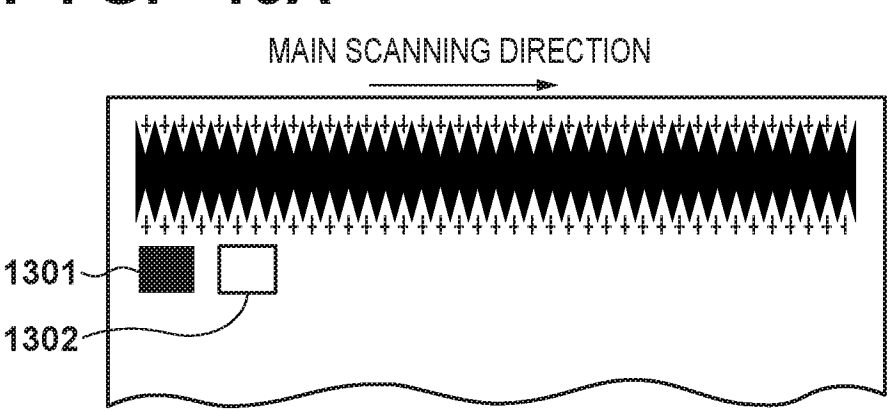
FIG. 13B
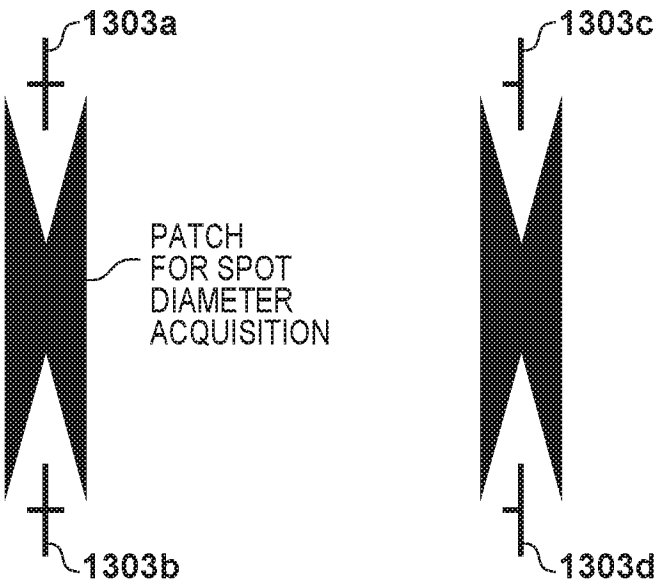
FIG. 13C
FIG. 13D
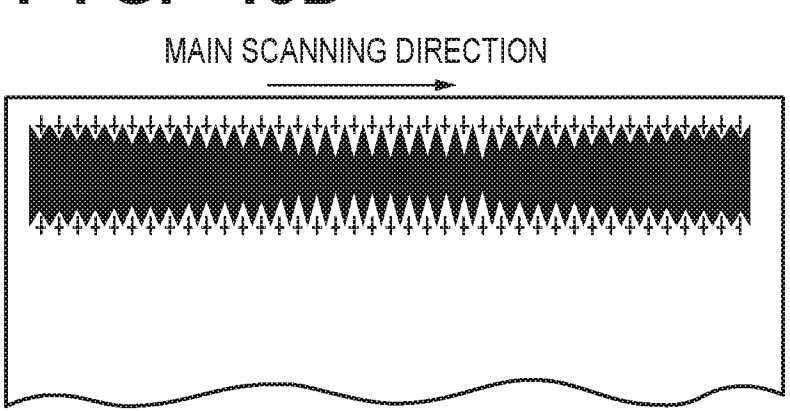
FIG. 13E
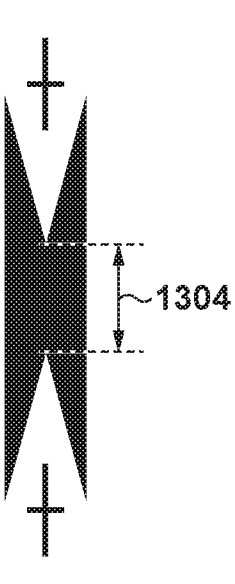
FIG. 13F
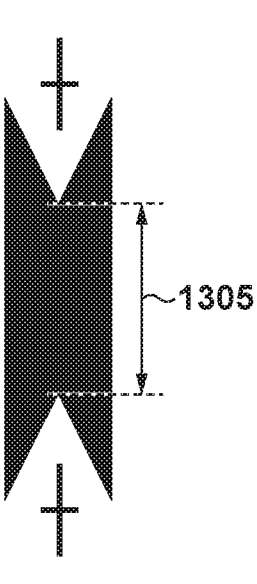

TONE CORRECTION IMAGE PROCESSING BASED ON PIXEL FORMATION POSITION ON A PHOTORECEPTOR

BACKGROUND OF THE INVENTION

Field of the Invention

The present invention relates to processing of image data in an image formation of an electrophotographic method.

Description of the Related Art

As exposure methods employed in an exposure unit of an electrophotographic image forming apparatus, there are an LED exposure method and a laser exposure method. The LED exposure method arranges a plurality of LED elements that are light-emitting elements in a lengthwise direction of a photoreceptor, and provides a plurality of lenses that focus light outputted by the LED elements on the photoreceptor. The laser exposure method has a light source unit that emits a laser beam by a semiconductor laser that is a light-emitting element, and a scanning unit that performs a laser beam deflecting scan by a polygon mirror. The laser exposure method further guides the laser beam from the light source unit to the scanning unit and has a plurality of lenses for forming an image using the laser beam, with which a deflecting scan is performed by the scanning unit, on the photoreceptor.

It is desirable for a light intensity distribution formed on a photoreceptor surface (hereinafter, a spot shape) to be approximately circular, and it is desirable for the size of the spot shape (hereinafter, spot diameter) to be approximately uniform irrespective of a position on the photoreceptor surface. Therefore, light output from the light-emitting element is designed so as to form an image by approximately uniform spot diameters on a photoreceptor surface after passing through a lens group.

In recent years, there are design examples in which, for an objective of miniaturization or a cost reduction, lens characteristics are simplified and spot diameters are not necessarily uniform. In addition, even with a design in which spot diameters are made to be uniform, there are cases in which there is an effect from distortion due to assembly error or a manufacturing error of a component part or a supporting body, so spot diameters change, and uniform spot diameters cannot be achieved. Nonuniformity of spot diameters appears in an output image as a difference in a tone characteristic depending on the scanning position, and causes so-called inplane uneven density to occur.

Japanese Patent Laid-Open No. 2006-349851 (hereinafter, PTL 1) discloses a technique for holding, with respect to each position in a main scanning direction, a plurality of two-dimensional tables for performing density correction in accordance with tonal values of an input image. To allow sufficient suppression of inplane uneven density by this technique, it is necessary to increase the number of the two-dimensional tables to be held for the density correction. By PTL 1, a test pattern having uniform density in a main scanning direction and a density gradient in a sub scanning direction is formed, a density of the test pattern is detected, and a correction table for correcting density unevenness of the main scanning direction is created. The test pattern is something that arranges a plurality of patches at equal intervals on an entire region of the main scanning direction.

By the technique of PTL 1, although an optimal correction table can be obtained for representative points that divide the main scanning direction into equal intervals (16 points in accordance with FIGS. 4 and 8 of PTL 1), correction residuals occur at other points. To have sufficiently small correction residuals, it is necessary to increase a number of divisions of the main scanning direction. However, increasing the number of divisions leads to an increase of a number of correction tables.

SUMMARY OF THE INVENTION

An objective of the present invention is to perform inplane uneven density correction that suppresses a number of tone correction properties and has few correction residuals. In addition, another objective is to maintain precision of inplane uneven density correction.

According to an aspect of the present invention, there is provided an image processing apparatus comprising: a holding unit configured to hold a plurality of tone correction properties respectively corresponding to a plurality of spot diameters that divide a range of spot diameters of light exposed on a surface of a photoreceptor by a predetermined interval; a setting unit configured to set a tone correction property selected from the plurality of tone correction properties based on a spot diameter on the photoreceptor for a pixel corresponding to pixel data; and a correction unit configured to correct the pixel data based on the set tone correction property, to generate tone correction data.

By virtue of the present invention, it is possible to perform inplane uneven density correction that suppresses a number of tone correction properties and has few correction residuals. In addition, it is possible to achieve maintaining precision of inplane uneven density correction.

Further features of the present invention will become apparent from the following description of exemplary embodiments (with reference to the attached drawings).

BRIEF DESCRIPTION OF THE DRAWINGS

FIG. 6 is a view illustrating an example of a spot diameter table.

FIGS. 13A-13F are views illustrating examples of test images.

DESCRIPTION OF THE EMBODIMENTS

Below, with reference to the drawings description is given in detail of an image forming apparatus, an image processing apparatus, and an image processing method of an embodiment according to the present invention. Note that these embodiments do not limit the present invention according to the scope of the claims, and not all of the combinations of configurations described in the embodiments are necessarily required with respect to the means to solve the problems according to the present invention.

[First Embodiment]

Figure 1A:
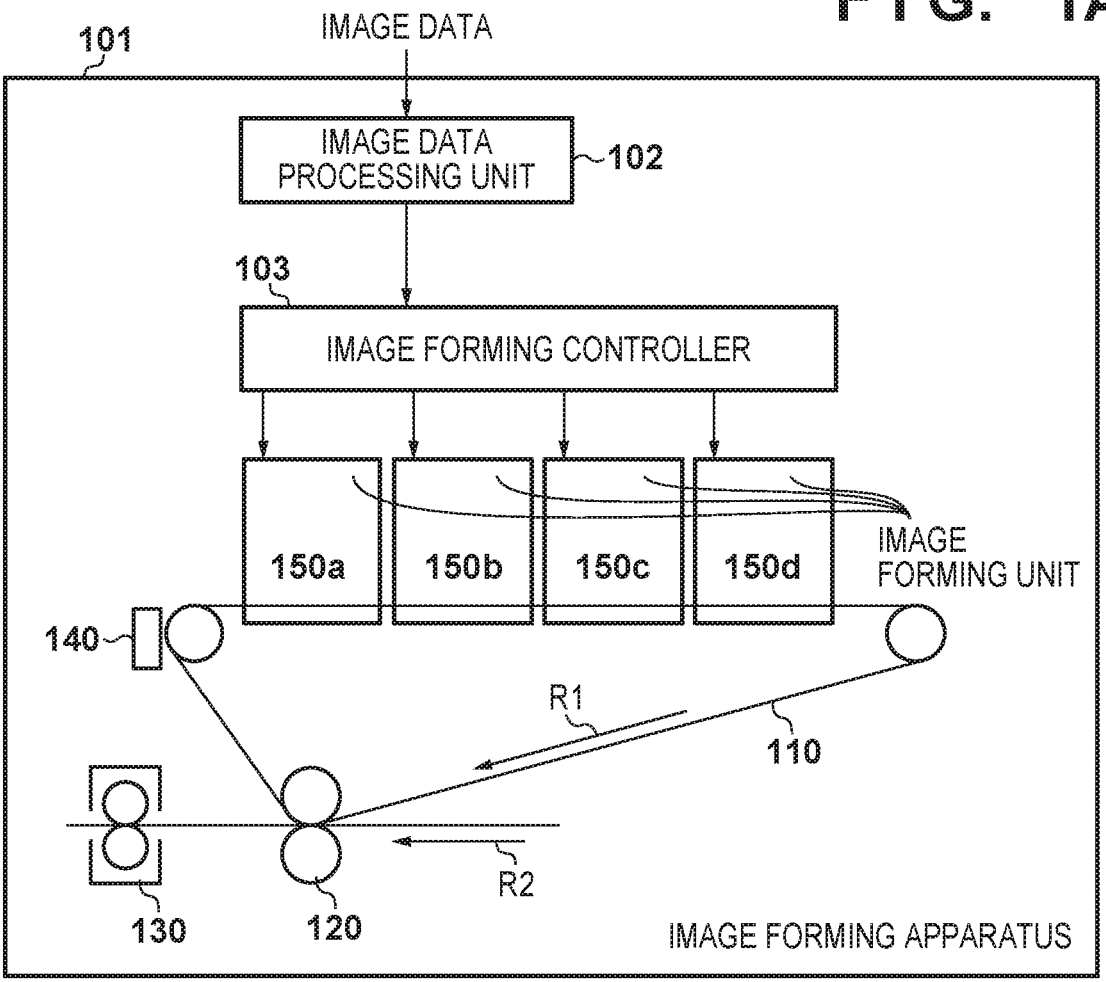
FIGS. 1A and 1B are views illustrating an overview configuration of the image forming apparatus of an embodiment.
Figure 1B:
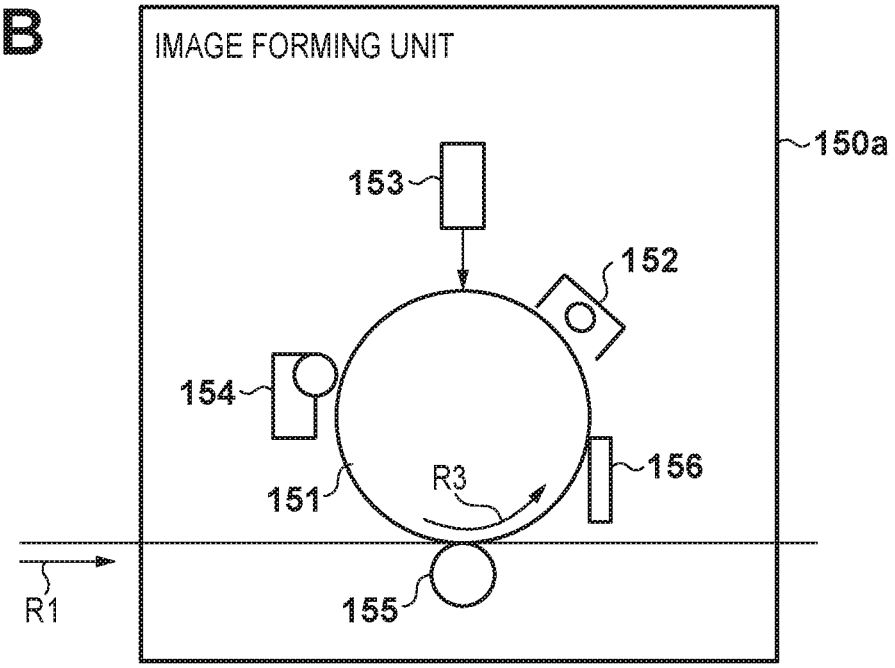

FIGS. 1A and 1B are views illustrating an overview configuration of an image forming apparatus 101 of an embodiment. As illustrated in FIG. 1A, the image forming apparatus 101 has a secondary transfer unit 120, an intermediate transfer belt cleaning unit 140, and image forming units 150*a*, 150*b*, 150*c*, and 150*d* along an intermediate transfer belt 110. A fixing unit 130 is arranged on a downstream side of the secondary transfer unit 120 (a downstream side in a conveyance direction for print paper). Explanation is given later for an image data processing unit 102 and an image forming controller 103.

Image Forming Unit

FIG. 1B illustrates an example configuration of the image forming unit 150*a*. It has a charging unit 152, an exposure unit 153, a developing unit 154, a primary transfer unit 155, and a cleaning unit 156 in a vicinity of a photoreceptor 151. The image forming units 150*a*, 150*b*, 150*c*, and 150*d* have the same configuration except for a point of using respectively different colored toners. As the toner, commonly four toner colors of cyan C, magenta M, yellow Y, and black K are used, and the image forming unit 150*a* uses C toner, the image forming unit 150*b* uses M toner, the image forming unit 150*c* uses Y toner, and the image forming unit 150*d* uses K toner. Note that image forming units and colors are not limited to four types, and image forming units and toner corresponding to light colors (light cyan Lc, light magenta Lm, grey Gy) or clear CL may be present. In addition, there is no limitation to an order of layering colors (an arrangement order of image forming units), which may be any order.

Operation of Image Forming Apparatus

The photoreceptor 151 has an organic photoconductor layer for which a charging polarity on an outer circumferential face thereof is a negative polarity, and rotates in a direction of an arrow symbol R3 illustrated in FIG. 1B. For the charging unit 152, a negative voltage is applied, and charged particles are irradiated on a surface of the photoreceptor 151 to cause the surface of the photoreceptor 151 to be uniformly charged to a negative potential. The exposure unit 153 irradiates a laser beam on the photoreceptor 151 in accordance with a drive signal input from the image forming controller 103, for example, and forms an electrostatic latent image on the surface of the charged photoreceptor 151.

The developing unit 154 uses a developing roller that rotates at approximately constant speed to supply toner charged to a negative polarity to the photoreceptor 151, causes the toner to adhere to the electrostatic latent image of the photoreceptor 151, and performs a reversal development of the electrostatic latent image. For the primary transfer unit 155, a positive voltage is applied, and it performs a primary transfer of the toner image, which is charged to a negative polarity and carried by the photoreceptor 151, to the intermediate transfer belt 110 that moves in a direction of an arrow symbol R1 illustrated in FIG. 1B. The cleaning unit 156 removes a remaining toner image that remains on the surface of the photoreceptor 151 after passing the primary transfer unit 155. The image forming units 150*a*, 150*b*, 150*c*, and 150*d* perform similar operations. When forming a color image, the image forming units 150*a*, 150*b*, 150*c*, and 150*d* execute each step of charging, exposing, developing, primary transfer, and cleaning at timing shifted by a predetermined interval. As a result, a full color toner image on which toner images of four colors have been overlapped is formed on the intermediate transfer belt 110.

The secondary transfer unit 120 performs a secondary transfer of the toner image carried on the intermediate transfer belt 110 to a print paper conveyed in a direction of an arrow symbol R2 illustrated in FIG. 1A. The fixing unit 130 performs pressurization and heating of the print paper to which the toner image has been transferred, and causes the toner image to fix to the print paper. The intermediate transfer belt cleaning unit 140 removes remaining toner that remains on the intermediate transfer belt 110 after passing the secondary transfer unit 120.

Image Data Processing Unit

Figure 2:
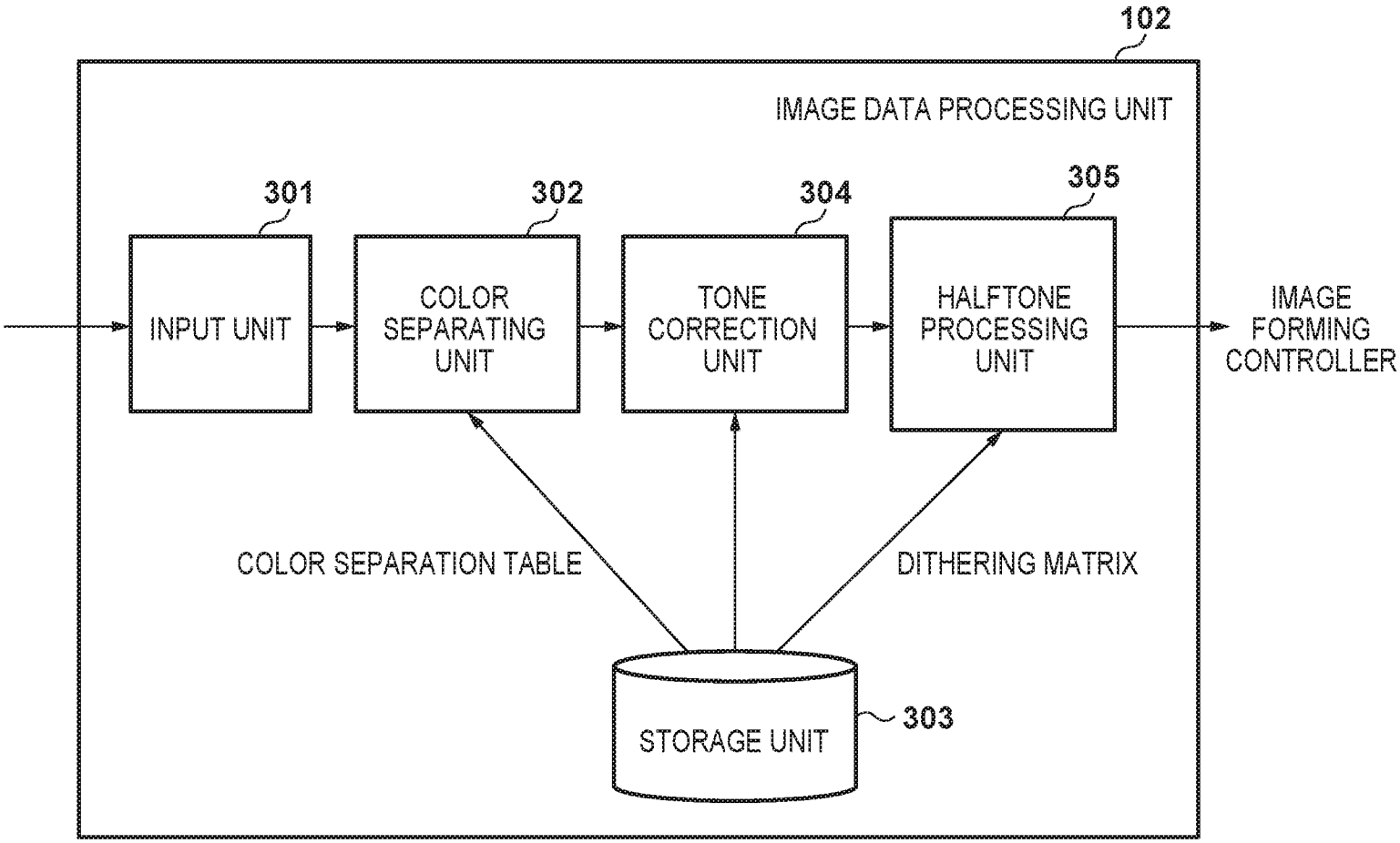
FIG. 2 is a block diagram illustrating an example configuration of an image data processing unit.

An example configuration of the image data processing unit 102 is illustrated by the block diagram of FIG. 2. An input unit 301 inputs multivalued image data (for example, 8 bits for each of RGB) from an external device such as a computer device, and converts a resolution of the image data into a print resolution of the image forming apparatus 101.

A color separating unit 302 refers to a color separation table stored in a storage unit 303, and performs a color decomposition of input image data into image data of each color of CMYK (for example, 8 bits for each of CMYK). For a tone correction unit 304 detail is described below, but it performs a tone correction process on image data of each color of CMYK based on information stored in the storage unit 303. A halftone processing unit 305 performs halftone processing on image data of each color of CMYK after tone correction, to convert it to image data of 4 bits for each of CMYK for example. Note that the halftone processing is performed by using a dither matrix stored in the storage unit 303, for example.

The image data processing unit 102 can also be configured as software. In such a case, in a computer device in which a program for the software is installed, the image data processing unit 102 functions as a printer driver for example.

Spot Diameter and Tone Characteristic

Figure 3A:
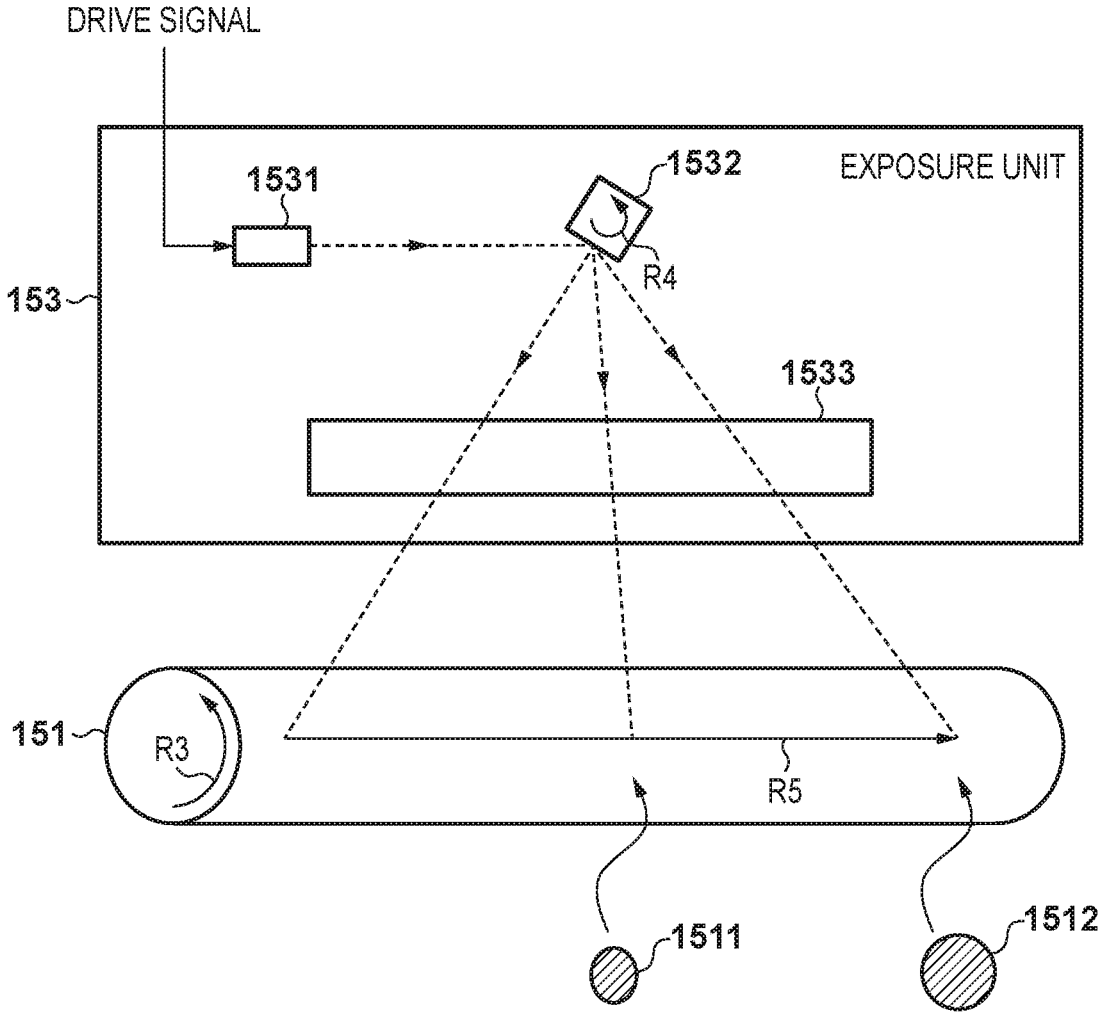
FIGS. 3A-3D are views for describing spot shapes and tone characteristics of light exposed on a surface of a photoreceptor.

As previously explained, it is desirable for a spot shape formed on a surface of the photoreceptor 151 to be approximately circular, and the spot diameter to be approximately uniform irrespective of the position on the surface of the photoreceptor 151. However, there are cases in which the spot diameter is not uniform due to simplification of lens characteristics through an objective of miniaturization or a cost reduction, or manufacturing error or assembly error of a component part or a supporting body. FIGS. 3A-3D are views for describing spot shapes and tone characteristics of light exposed on a surface of the photoreceptor 151. A light-emitting element 1531 of the exposure unit 153 illustrated in FIG. 3A is configured by one or a plurality of semiconductor laser elements. A laser beam output by the light-emitting element 1531 passes a collimating lens, an aperture stop, and a cylindrical lens (not shown), is reflected by a reflecting surface of a polygon mirror 1532 to then pass through an optical element 1533, and to form an image on a surface of the photoreceptor 151.

The laser beam reflected by the reflecting surface of the polygon mirror 1532 which rotates at a fixed speed in a direction of the arrow symbol R4 illustrated in FIG. 3A makes a deflecting scan in a direction of the arrow symbol R5 (a main scanning direction) on the photoreceptor 151. Ordinarily design is such that, by operation of the optical element 1533, a laser beam forms an image by an approximately uniform spot diameters on the surface of the photoreceptor 151. However, there are cases where the spot diameter is not necessarily uniform due to the above reasons. For example, there are cases in which a diameter of a spot shape 1512 of an end portion of the main scanning direction of the photoreceptor 151 becomes larger than a diameter of a spot shape 1511 of a central portion of the main scanning direction of the photoreceptor 151. If the spot diameter is non-uniform, a problem occurs in that a tone characteristic of an output image differs in accordance with the spot diameter. Note that the tone characteristic indicates a correspondence relationship between the density indicated by input image data and the density of an output image. Description is given below of a case, as illustrated in FIG. 3A, in which the spot diameter becomes larger the closer the main scanning direction gets to an end portion, in comparison to the spot diameter at a central portion of the main scanning direction.

Figure 3B:
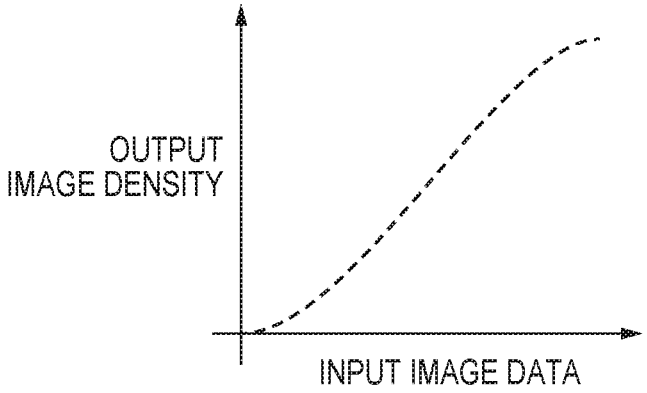
Figure 3C:
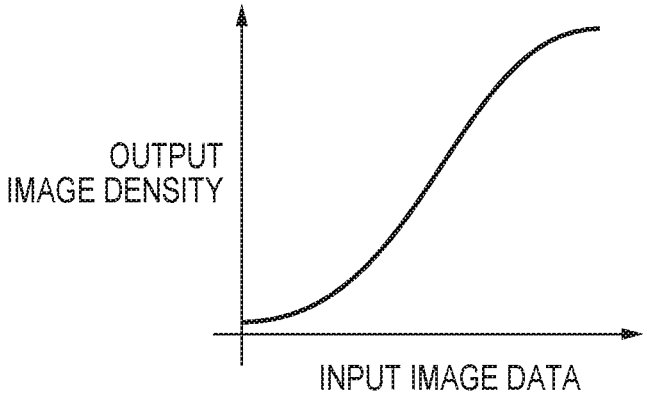
Figure 3D:
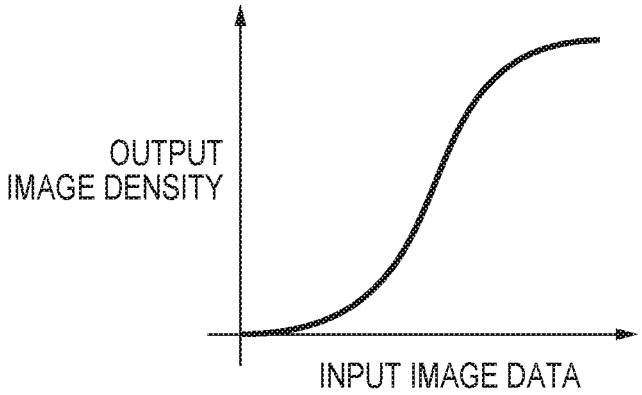

FIG. 3B illustrates a tone characteristic at a position where the spot diameter at a central portion of the main scanning direction becomes smallest. FIG. 3D illustrates a tone characteristic at a position where the spot diameter at an end portion of the main scanning direction largest. FIG. 3C illustrates a tone characteristic at an intermediate position between the central portion and an end portion (a position where the spot diameter has an intermediate size). As illustrated in FIGS. 3B, 3C, and 3D, it is known that as the spot diameter increases, curvature of graph indicating a tone characteristic becomes big. The reason is that, if the spot diameter is large, in a highlight portion an independent dot for which exposure intensity has become weak due to spreading of the spot diameter is formed on the photoreceptor, and density decreases due to a toner apply amount for the independent dot decreasing. Meanwhile, in a shadow portion, a toner apply amount for a blank portion having a narrow width increases due to spreading of the spot diameter, and density increases. In other words, the tone characteristic of an output image changes in accordance with a spot diameter that depends on a position, and inplane uneven density occurs.

A tone correction process for making a relation between the tone characteristic of image data and the tone characteristic of an output image to be linear is processing that uses a tone correction table having a characteristic inverse to the tone characteristic of the output image to transform the image data. Differing to a tone correction process for image data, tone correction properties corresponding to a position on the photoreceptor 151 are necessary to suppress inplane uneven density caused by a change of a tone characteristic in relation to the position on the photoreceptor 151. However, if tone correction properties for all positions on the photoreceptor 151 are created and held in a tone correction table, this invites an increase in effort for calibration (adjustment of tone correction properties) and an increase in a memory region for holding the tone correction table, and is not practical.

Accordingly, it is possible to consider holding tone correction properties adjusted at representative positions on the photoreceptor 151 (hereinafter, representative tone correction properties), and generating the tone correction properties for other positions (hereinafter, non-representative positions) from representative tone correction properties. In other words, representative positions are arranged evenly spaced apart on the photoreceptor 151, and tone correction properties of a non-representative position are generated by a linear interpolation of representative tone correction properties for two nearest neighbors. In such a case, if the distances between the non-representative position and nearest neighbor representative positions P1 and P2 is L1 and L2, tone correction properties for the non-representative position are generated by mix (blending) at a ratio of L2:L1 the tone correction properties of the representative position P1 and the tone correction properties of the representative position P2.

Tone correction properties for a position other than a representative position differ to something that is truly optimal, and a slight correction residual occurs in the tone characteristic. It is possible to reduce the correction residual by increasing the number of representative positions. In other words, there is a trade-off relation between a number of tables that hold representative tone correction properties and suppression of inplane uneven density.

Figure 4:
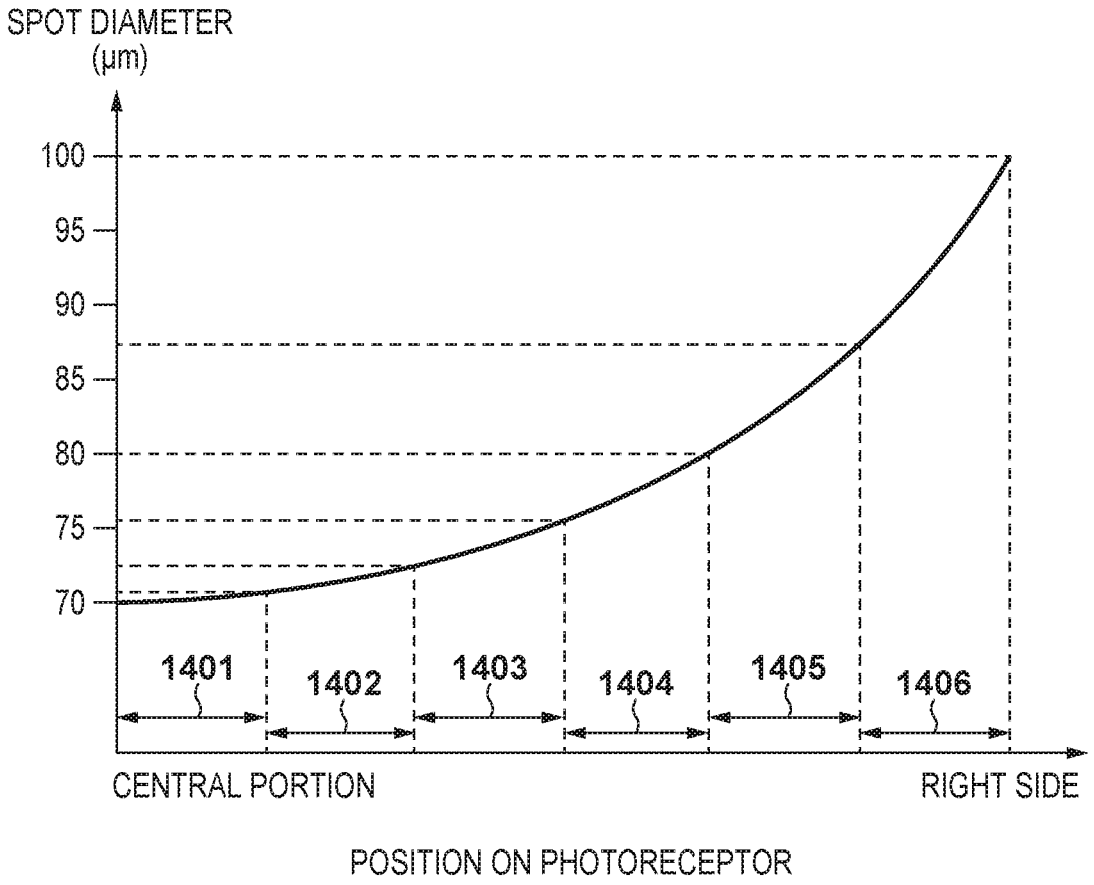
FIG. 4 is a view illustrating an example of a relation between a position in the main scanning direction on the photoreceptor, and change of a spot diameter.

Such a correction residual occurs because change of the spot diameter in the main scanning direction on the photoreceptor 151 is not uniform, and occurs easily at a position where change of the spot diameter is sharp. FIG. 4 is a view illustrating an example of a relation between a position in the main scanning direction on the photoreceptor 151, and change of a spot diameter. As illustrated in FIG. 4, there is a tendency that a change rate for the spot diameter is small near a central portion of the photoreceptor 151, and that the spot diameter sharply changes near a right side (or a left side) of the photoreceptor 151.

In a case of illustrating the change of the spot diameter illustrated in FIG. 4, the correction residual becomes large in a vicinity of both ends of the photoreceptor 151. Vertical broken lines illustrate representative positions, and out of a plurality of segments segmented by the representative positions, larger correction residuals occur in intermediate segments 1403 and 1404 in comparison to segments 1401 and 1402 which are close to the central portion. Furthermore, larger correction residuals occur in segments 1405 or 1406 which are close to the right side.

Accordingly, a plurality of tone correction properties corresponding to a plurality of different spot diameters are generated, and held as a plurality of tone correction tables. Tone correction properties for a non-representative position are set by blending the tone correction properties indicated by these tone correction tables at a ratio in accordance with the spot diameter. At that time, the correction residuals are reduced by deciding representative positions such that change of the spot diameter becomes approximately uniform. Therefore, it is possible to perform a tone correction process having fewer correction residuals in comparison to a case in which the representative positions are arranged evenly spaced apart on the photoreceptor 151, when the number of segments is the same.

Tone Correction Unit

Figure 5:
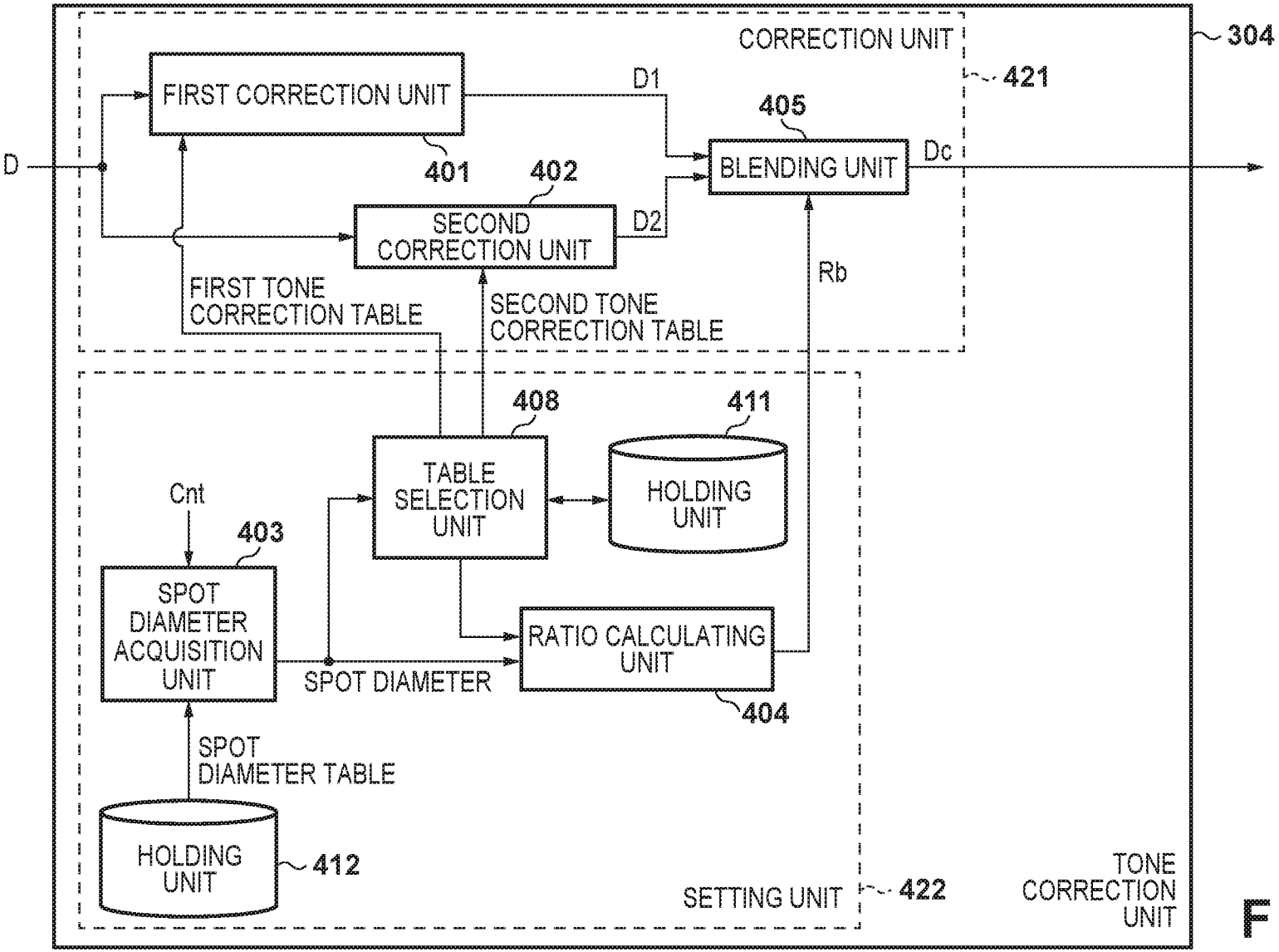
FIG. 5 is a block diagram illustrating an example configuration of an image processing unit.

An example configuration of the tone correction unit 304 is illustrated by the block diagram of FIG. 5. The tone correction unit 304 has a correction unit 421 for generating tone correction data, and a setting unit 422 for setting a blend ratio for a plurality of pieces of correction data. In the setting unit 422 a spot diameter acquisition unit 403 calculates a formation position Pp on the photoreceptor 151 of a processed-pixel based on a count value Cnt, and acquires a spot diameter from a spot diameter table held by a holding unit 412.

FIG. 6 is a view illustrating an example of a spot diameter table. A spot diameter table illustrated in FIG. 6, which takes a left side of the photoreceptor 151 as −128, 0 for the center, and the right side as 127, holds spot diameters for several positions between −128 corresponding to the left side and 127 corresponding to the right side (in FIG. 6 the positions correspond to integers). In such a case, the formation position Pp on the photoreceptor 151 of the processed-pixel is calculated by the following equation.

$$Pp=\text{floor}(Cnt/Xw\times 255-128) \quad (1)$$

Here Cnt is information indicating at what number pixel from a left side portion of the image a processed-pixel is positioned at, Xw is a number of pixels corresponding to the effective main scanning range of the photoreceptor 151, and floor( ) is a floor function.

The spot diameter table is created in advance based on a result of measuring the spot diameter on a photosensitive drum at a time of manufacturing, a simulation at the time of designing, or the like, and are held. As previously described, the spot diameter with respect to a position on the photosensitive drum does not change uniformly, but changes nonlinearly. Therefore, it is desirable to create the spot diameter table based on only a number of pieces of data sufficient to smoothly represent change of the spot diameter in the main scanning direction (256 pieces of data in the example illustrated). At the least, creation of the spot diameter table requires performing a plurality of measurements of the spot diameter at non-representative positions that are described later.

Although detail is explained later, a table selection unit 408 selects first and second tone correction tables from the plurality of tone correction tables held by a holding unit 411 based on a spot diameter acquired by the spot diameter acquisition unit 403 (hereinafter, the acquired spot diameter). Although detail is explained later, a ratio calculating unit 404 calculates a ratio Rb based on the acquired spot diameter and spot diameters corresponding to the first and the second tone correction tables.

In the correction unit 421, a first correction unit 401 uses the first tone correction table to generate first correction data D1 by performing a tone correction process on pixel data D input from the image data processing unit 102. A second correction unit 402 uses the second tone correction table to generate second correction data D2 by performing a tone correction process on the pixel data D. A blending unit 405 outputs tone correction data Dc that blends the first correction data D1 and the second correction data D2 by the following equation, based on the ratio Rb input from the ratio calculating unit 404.

$$Dc=\text{int}\{(1-Rb)\times D1+Rb\times D2\} \quad (2)$$

Here, $0\leq Rb\leq 1$, and int( ) is a function for truncating past a decimal point.

The tone correction data Dc calculated here is input to the halftone processing unit 305. The image forming controller 103 generates a drive signal for the light-emitting element 1531 of the exposure unit 153 on which a pulse width modulation has been performed based on data on which halftone processing has been performed, and supplies the drive signal to the image forming unit 150*a*. In addition, although FIG. 5 illustrates two holding units 411 and 412 that are configured by flash memories or EEPROM for example, a configuration in which the plurality of tone correction tables and the spot diameter table are held in one holding unit may be used.

Image Data Processing

Figure 21:
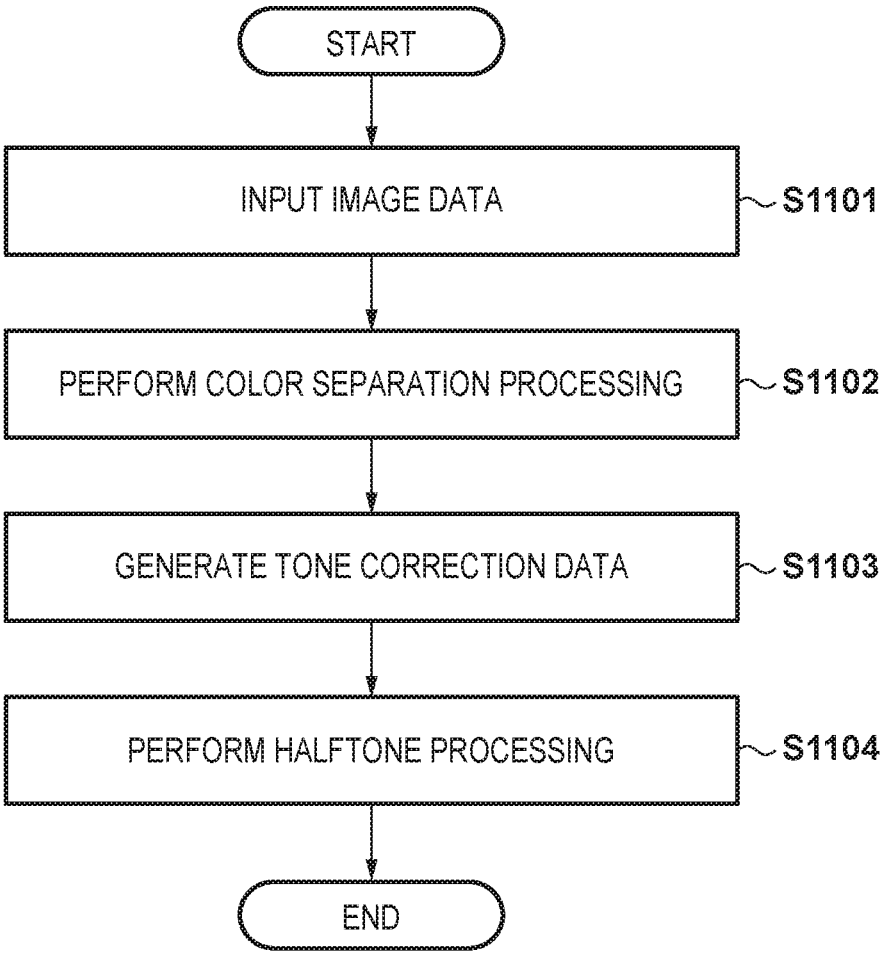
FIG. 21 is a flowchart illustrating processing of an image data processing unit.

As illustrated in FIG. 21, the image data processing unit 102 of the present embodiment performs, similarly to usual, processing in an order of input of image data (step S1101), color separation processing (step S1102), generation processing for tone correction data (step S1103) and halftone processing (step S1104). A feature of the present invention is in the processing details of the generation processing for the tone correction data (step S1103). Generation processing for tone correction data (step S1103) is performed based on the formation position Pp on the photoreceptor 151 and the pixel value of a pixel, for each of all pixels of image data of each color of CMYK generated by the color separating unit 302. A calculation method for the formation position Pp is as previously described.

Plurality of Tone Correction Tables and Selection Method Thereof

Figures 7A, 7B:
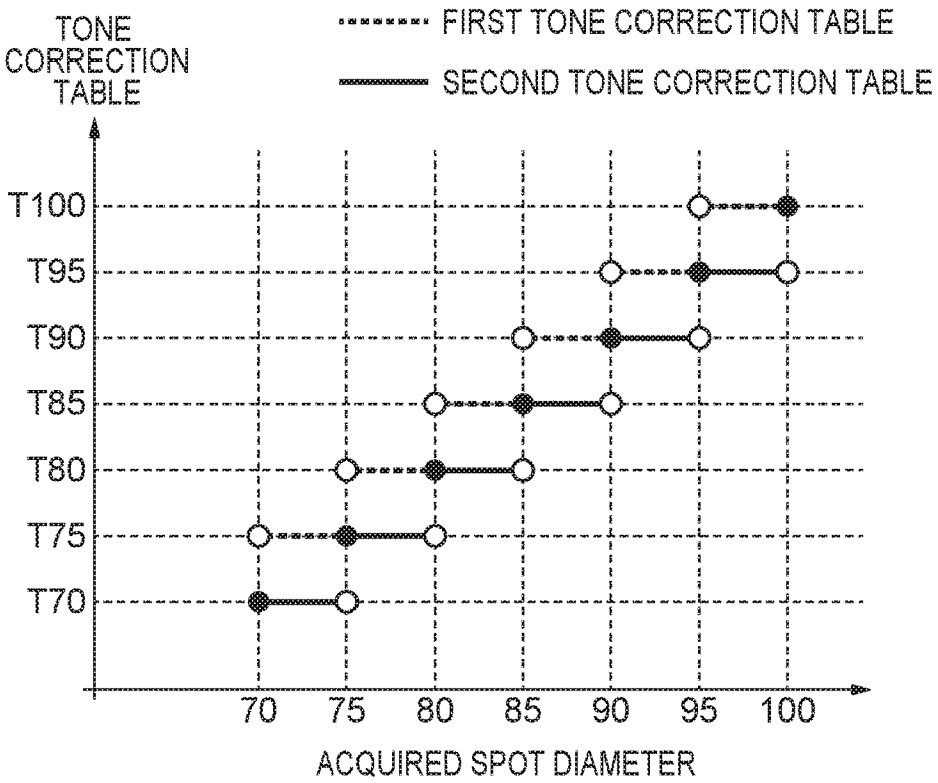
FIGS. 7A and 7B are views for describing an example of a plurality of tone correction tables held by a holding unit, and a tone correction table selected with respect to an acquired spot diameter.

FIG. 7A illustrates an example of a plurality of tone correction tables held by the holding unit 411. The holding unit 411 holds as tone correction tables a plurality of tone correction properties corresponding to each of a plurality of spot diameters that divide a range of the spot diameter (for example 70 μm to 100 μm) by a predetermined interval (for example 5 μm), for example. In FIG. 7A, a tone correction table T70 corresponds to a spot diameter of 70 μm, a tone correction table T75 corresponds to a spot diameter of 75 μm, . . . , and a tone correction table T100 corresponds to a spot diameter of 100 μm.

Each tone correction table is designed so that the relation between the tone characteristic of input data and the tone characteristic of an output image becomes linear in accordance with the corresponding spot diameter. Note that FIG. 7A illustrates an example in which input and output are 8-bit, but there is no limitation to this. In addition, 5 μm is illustrated as an example of an interval for spot diameters, but the interval may be 2.5 μm, 10 μm, 15 μm, or the like. As previously explained, a number of tables for holding tone correction properties and the suppression of inplane uneven density are in a trade-off relation, and the number of tables—in other words the interval of spot diameters—may be set such that desired inplane uneven density suppression is achieved.

By FIG. 7B description is given of a tone correction table selected for the acquired spot diameter. From the plurality of tone correction tables held by the holding unit 412, the table selection unit 408 selects a tone correction table corresponding to the smallest spot diameter greater than or equal to the acquired spot diameter as the first tone correction table. From the plurality of tone correction tables held by the holding unit 412, a tone correction table corresponding to the largest spot diameter less than or equal to the acquired spot diameter is selected as the second correction table.

If the holding unit 412 holds the tone correction tables T70, T75, . . . , T100 illustrated in FIG. 7A and the acquired spot diameter is 77 μm, a tone correction table T80 corresponding to a spot diameter of 80 μm is selected as the first tone correction table. In addition, the tone correction table T75 which corresponds to a spot diameter of 75 μm is selected as the second tone correction table. In other words, two tone correction tables corresponding to two spot diameters that sandwich the acquired spot diameter (have therebetween) are selected. In addition, if the acquired spot diameter is 90 μm, the tone correction table T90 which corresponds to a spot diameter of 90 μm is selected as the first and second correction tables. Alternatively, configuration may be taken to select a next closest tone correction table as either the first or the second tone correction table. In such a case, T90 is selected as the first tone correction table and T85 is selected as the second tone correction table, or T90 is selected as the second tone correction table and T95 is selected as the first tone correction table.

Figure 8:
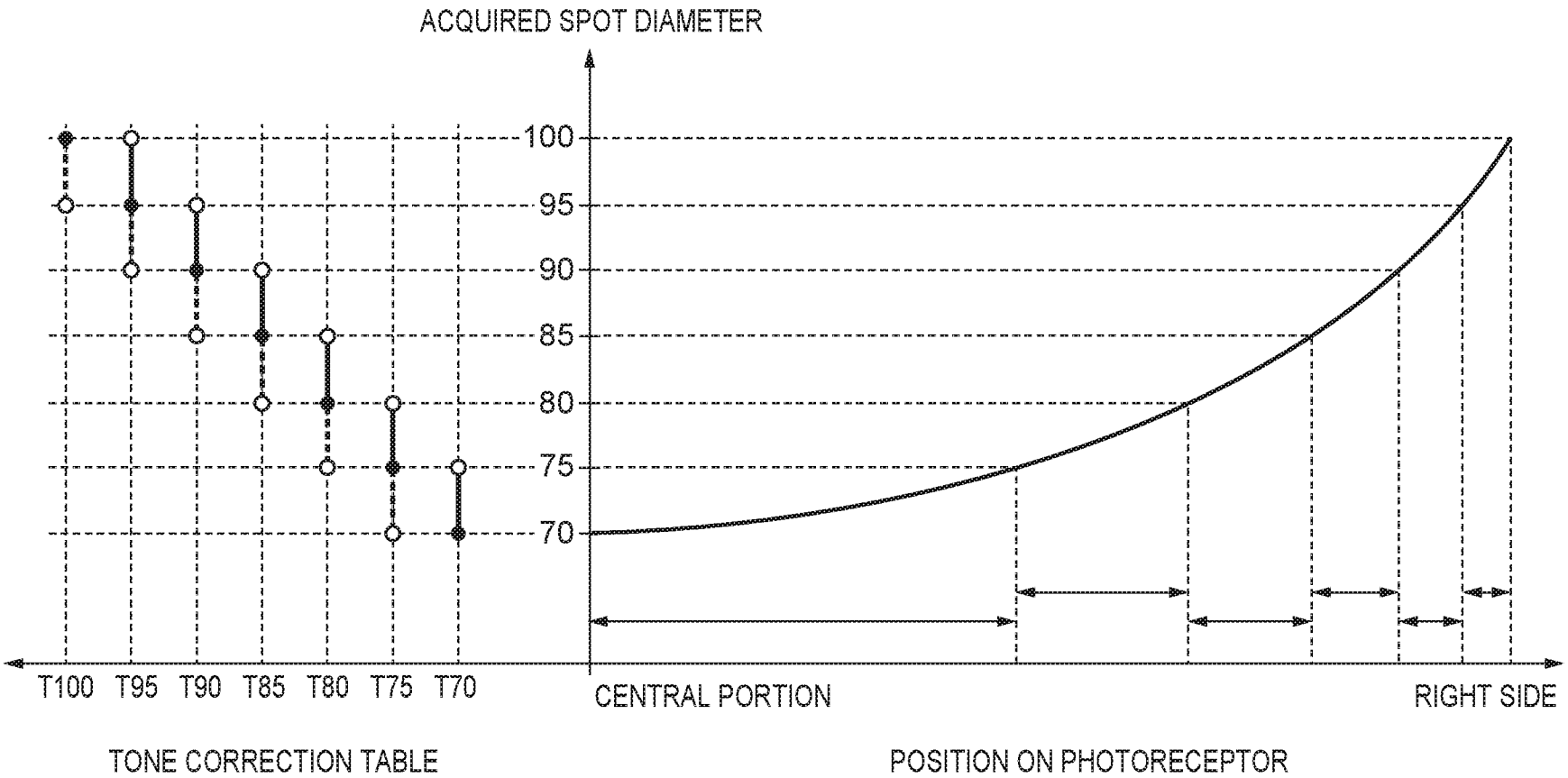
FIG. 8 is a view illustrating an example of a relation between a position in a main scanning direction on a photoreceptor, a spot diameter, and a selected tone correction table.

FIG. 8 illustrates an example of a relation between a selected tone correction table, a spot diameter, and a position in the main scanning direction on the photoreceptor 151. In a vicinity of the central portion of the photoreceptor 151 where change of the spot diameter is small, a segment for which the same tone correction table is selected becomes wide, and, in a vicinity of the right side (or left side) of the photoreceptor 151 where change of the spot diameter is large, a segment for which the same tone correction table is selected becomes narrow. In other words, in a portion for which change of the spot diameter is sharp, the tone correction table frequently changes. Although the number of representative positions is the same, change of the spot diameter in each segment is suppressed in comparison to the case of the example of FIG. 4 in which the representative positions are arranged evenly spaced apart on the photoreceptor 151. For example, the spot diameter in a segment changes by a maximum of 12-13 μm in the example illustrated in FIG. 4, but changes by 5 μm in the example illustrated in FIG. 8.

Generation Processing for Tone Correction Data

Figure 9:
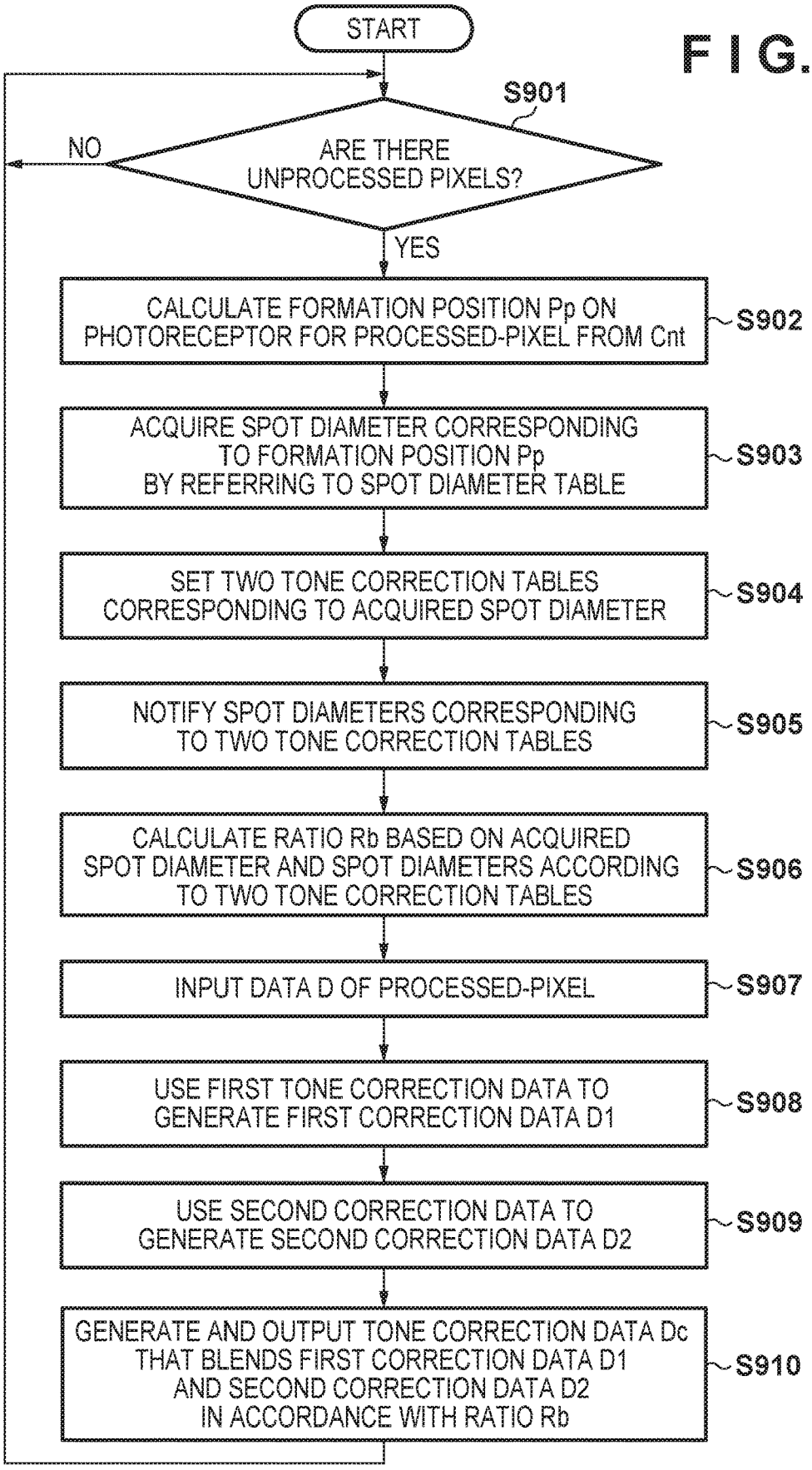
FIG. 9 is a flowchart for describing processing for generating tone correction data from pixel data.

The flowchart of FIG. 9 describes processing for generating tone correction data from pixel data. The tone correction unit 304 determines whether there are unprocessed pixels (step S901), and if there are unprocessed pixels designates one pixel of the unprocessed pixels as a processed-pixel. The spot diameter acquisition unit 403 calculates the formation position Pp on the photoreceptor 151 for the processed-pixel (step S902) and acquires a spot diameter for the formation position Pp from the spot diameter table (step S903). The table selection unit 408 selects two tone correction tables corresponding to the acquired spot diameter and sets them in the correction unit 421 (step S904), and notifies the ratio calculating unit 404 of spot diameters that two tone correction tables correspond to (step S905).

The ratio calculating unit 404 calculates the ratio Rb based on the acquired spot diameter and the spot diameters corresponding to the two tone correction tables (step S906). For example, a ratio at which the acquired spot diameter internally divides the range of spot diameters that two tone correction tables correspond to may be calculated. In other words, if the acquired spot diameter internally divides the range of the spot diameters by s:1−s, then the ratio Rb=s is calculated. For example, in a case where the acquired spot diameter is 72 μm and the range of the spot diameters is 70-75 μm, because an interior division ratio is 0.4:1−0.4, a ratio Rb=0.4 is calculated. Of course, a calculation method for the ratio is not limited to this, and a method that uses another function or a method that uses a table can be employed.

The correction unit 421 inputs the pixel data D of the processed-pixel (step S907). The first correction unit 401 uses one of the set tone correction tables (the first tone correction table) to generate the first correction data D1 that corrects the pixel data D (step S908). The second correction unit 402 uses the other of the set tone correction tables (the second tone correction table) to generate the second correction data D2 that corrects the pixel data D (step S909). The blending unit 405 generates and outputs tone correction data Dc that blends the first correction data D1 and the second correction data D2 in accordance with the ratio Rb input from the ratio calculating unit 404 (step S910). After output of the tone correction data Dc, the processing returns to step S901, and if there are unprocessed pixels the processing of step S902 to step S910 is repeated. FIG. 9 illustrates just processing that corresponds to pixel data of a cyan component for example, but processing of other color components is executed similarly.

In this way, two pieces of correction data for which a tone correction is performed by switching two tone correction properties in accordance with change of a spot diameter corresponding to a formation position on the photoreceptor of a processed-pixel are generated. The pieces of correction data are blended in accordance with the ratio Rb which is calculated from a spot diameter and a range of spot diameters that the two tone correction properties correspond to. Therefore, substantially the pixel data of the processed-pixel is subject to a tone correction in accordance with tone correction properties corresponding to the formation position on the photoreceptor of the processed-pixel. As a result, it is possible to absorb differences in tone characteristics caused by change of the spot diameter, and realize suitable inplane uneven density correction that has a small correction residual. A method of using tone correction properties obtained by a linear interpolation of tone correction properties of representative positions based on a relation between representative positions and non-representative positions on a photoreceptor to perform a tone correction of a non-representative position is likely to be subject to effects from change of the spot diameter, and correction residuals become larger in a region where the spot diameter changes sharply. Such a tone correction method is referred to as a "formation position based tone correction method".

In contrast to this, a method of using tone correction properties obtained by performing a linear interpolation of tone correction properties corresponding to spot diameters to perform a tone correction based on a spot diameter is unlikely to be subject to an effect of change of the spot diameter, and can suppress a correction residual to be small in a region where the spot diameter changes sharply. Such a tone correction method of an embodiment is referred to as a "spot diameter based tone correction method".

[Second Embodiment]

Below, description is given of an image forming apparatus, an image processing apparatus, and an image processing method of a second embodiment according to the present invention. Note that, in the second embodiment, for configurations approximately similar to that in the first embodiment, there are cases in which the same reference numerals are added and detailed description thereof is omitted. In the first embodiment, description was given of an example in which two tone correction tables were selected in accordance with an acquired spot diameter, and tone correction properties that blend tone correction properties of these tone correction tables in accordance with the ratio Rb are substantially used in generation of tone correction data Dc. In the second embodiment, description is given of method in which one tone correction table is selected in accordance with the acquired spot diameter to generate the tone correction data Dc.

Figure 10:
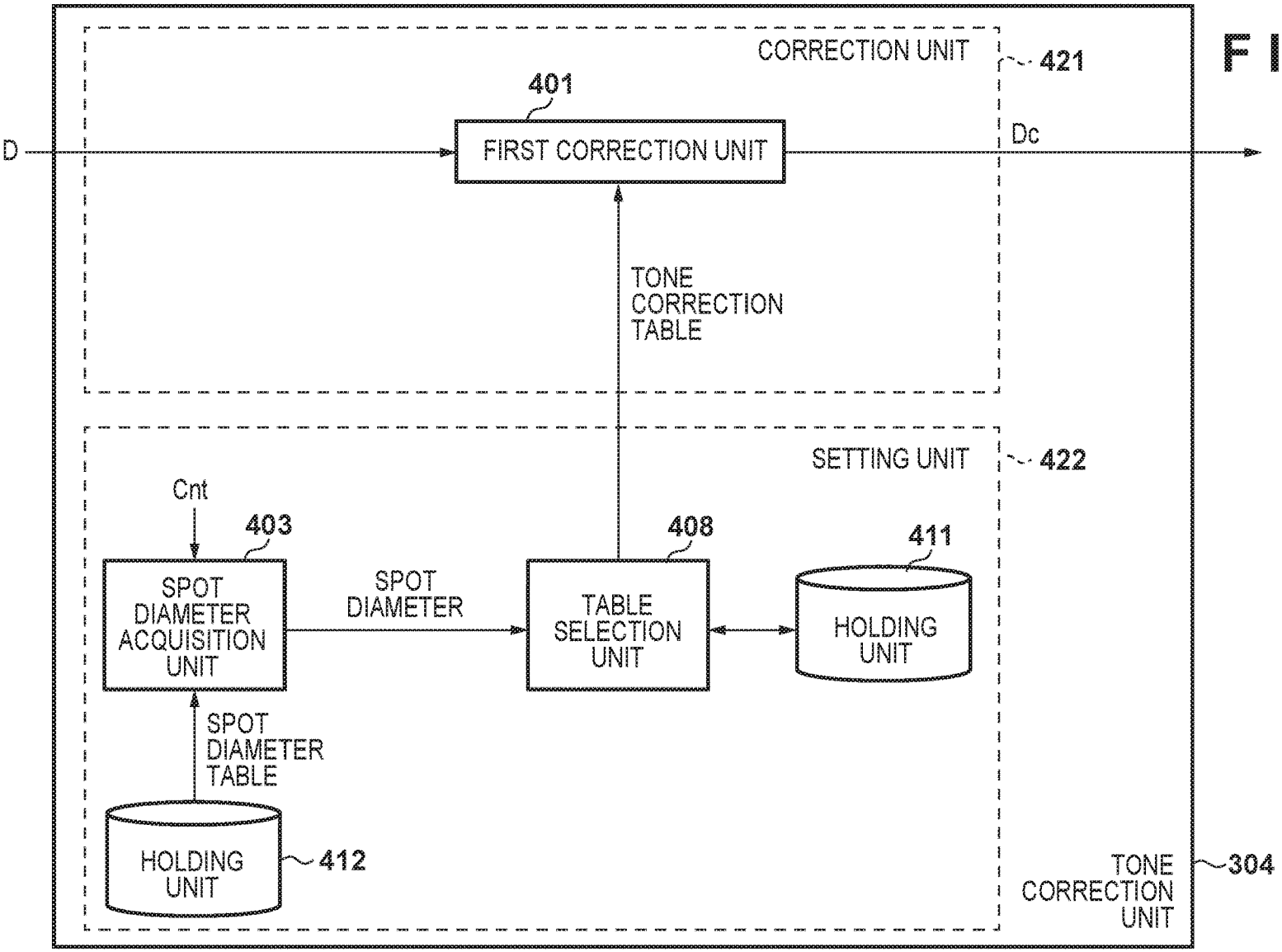
FIG. 10 is a block diagram illustrating an example configuration of an image processing unit of a second embodiment.

The block diagram of FIG. 10 illustrates an example configuration of the tone correction unit 304 of the second embodiment. Portions different to the configuration of the first embodiment are the points that the second correction unit 402 and the blending unit 405 are deleted from the correction unit 421, and that the ratio calculating unit 404 is deleted from the setting unit 422. The table selection unit 408 selects a tone correction table corresponding to the acquired spot diameter from a plurality of tone correction tables held by the holding unit 411. A tone correction unit 401 which is a first correction unit in the first embodiment generates tone correction data Dc for performing a tone correction process on the pixel data D by using the selected tone correction table.

Figure 11A:
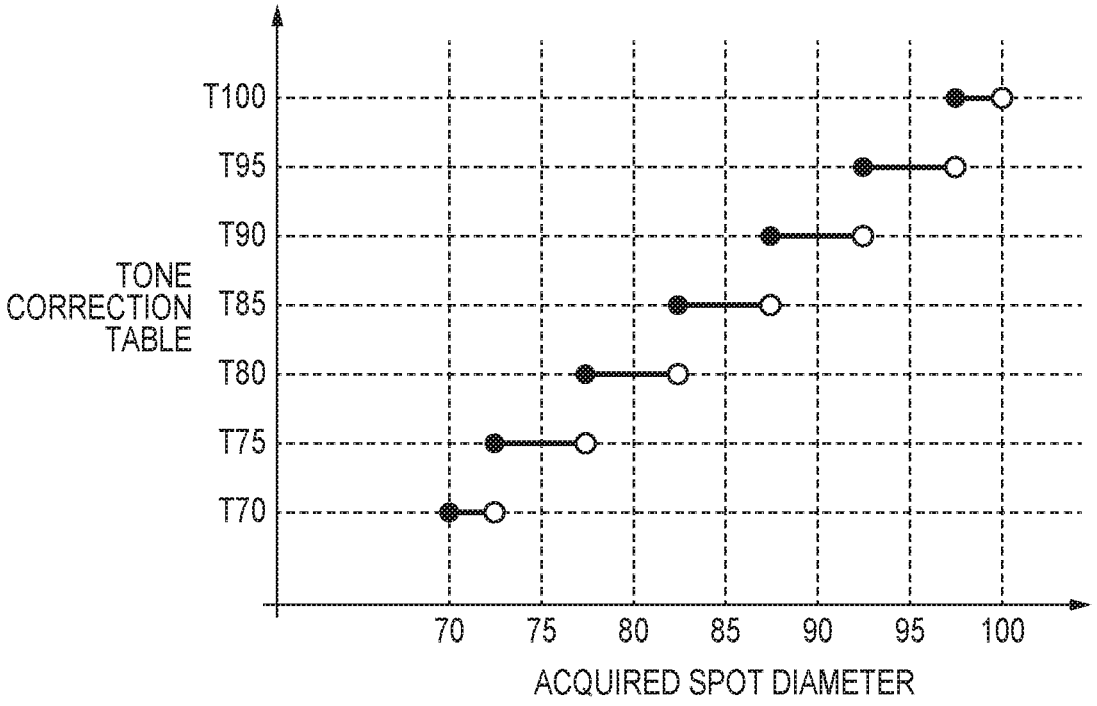
FIGS. 11A and 11B are views for describing a tone correction table selected with respect to an acquired spot diameter, and an example of a relation between a position in a main scanning direction on a photoreceptor, a spot diameter, and the selected tone correction table.
Figure 11B:
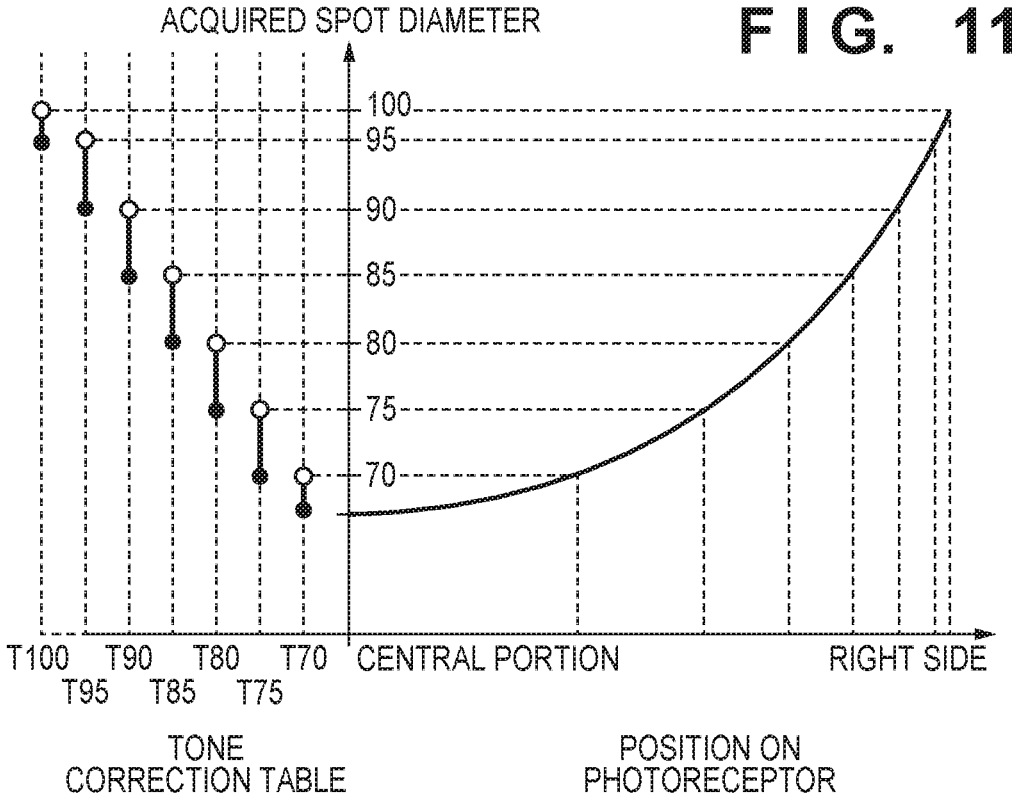

FIGS. 11A and 11B illustrate an example of relations between tone correction tables selected for acquired spot diameters, and positions in the main scanning direction on the photoreceptor 151, spot diameter, and the selected tone correction tables. The table selection unit 408 selects a tone correction table corresponding to a spot diameter closest to the acquired spot diameter from the plurality of tone correction tables held by the holding unit 411, as illustrated in FIG. 11A. For example, if the acquired spot diameter is 77 μm, the tone correction table T75 which corresponds to the spot diameter of 75 μm is selected. If there are plural tone correction tables corresponding to spot diameters closest to the acquired spot diameter, one is further selected by a separate rule (for example, a tone correction table corresponding to a larger spot diameter is selected). For example, if the holding unit 411 holds the tone correction tables illustrated in FIG. 7A and the acquired spot diameter is 77.5 μm, there are two tone correction tables—T80 and T75—corresponding to spot diameters closest to the acquired spot diameter. In such a case, the tone correction table T80 corresponding to the larger spot diameter is ultimately selected.

As illustrated by FIG. 11B, in a vicinity of the central portion of the photoreceptor 151 where change of the spot diameter is small, a segment for which the same tone correction table is selected becomes wide, and, in a vicinity of the right side (or left side) of the photoreceptor 151 where change of the spot diameter is large, a segment for which the same tone correction table is selected becomes narrow. In other words, similarly to the first embodiment, in a portion for which change of the spot diameter is sharp, the tone correction table frequently changes. In this way, tone correction data Cc is generated in accordance with one tone correction table selected based on the spot diameter. Consequently, the tone correction method of the second embodiment is also a type of a spot diameter based tone correction method, and although correction residuals become larger in comparison to the first embodiment, it is possible to suppress the correction residuals to be smaller than with a formation position based tone correction method in a region where the spot diameter changes sharply.

[Variation]

Description was given above of an example of performing processing that uses tables, such as a tone correction table and a spot diameter table, but a matrix operation or a function that approximates input-output characteristics of a table may be used in place of the table.

[Third Embodiment]

Below, description is given of an image forming apparatus, an image processing apparatus, an image processing method, a calibration apparatus, and a calibration method of a third embodiment according to the present invention. Note that, in the third embodiment, for configurations approximately similar to that in the first and second embodiments, there are cases in which the same reference numerals are added and detailed description thereof is omitted. In the first and second embodiments, description was given for spot diameter based tone correction methods. The spot diameter at each position on the photoreceptor changes due to thermal deformation, temporal change, or the like. Therefore, for a spot diameter table used in a spot diameter based tone correction method (information of a spot diameter at each position on a photoreceptor), performing calibration at a predetermined timing is necessary. By appropriately performing the calibration, it is possible to handle change of the spot diameter that occurs due to thermal deformation, temporal change, or the like.

However, it is very difficult to actually measure the spot diameter at each position of a photoreceptor, and calibration by actually measuring the spot diameter after shipment of a product is substantially impossible. In the third embodiment, by measuring an effective spot diameter at each position on a photoreceptor by using a simple test chart after product shipment, calibration of a spot diameter table is realized.

[Tone Correction Unit]

Figure 12:
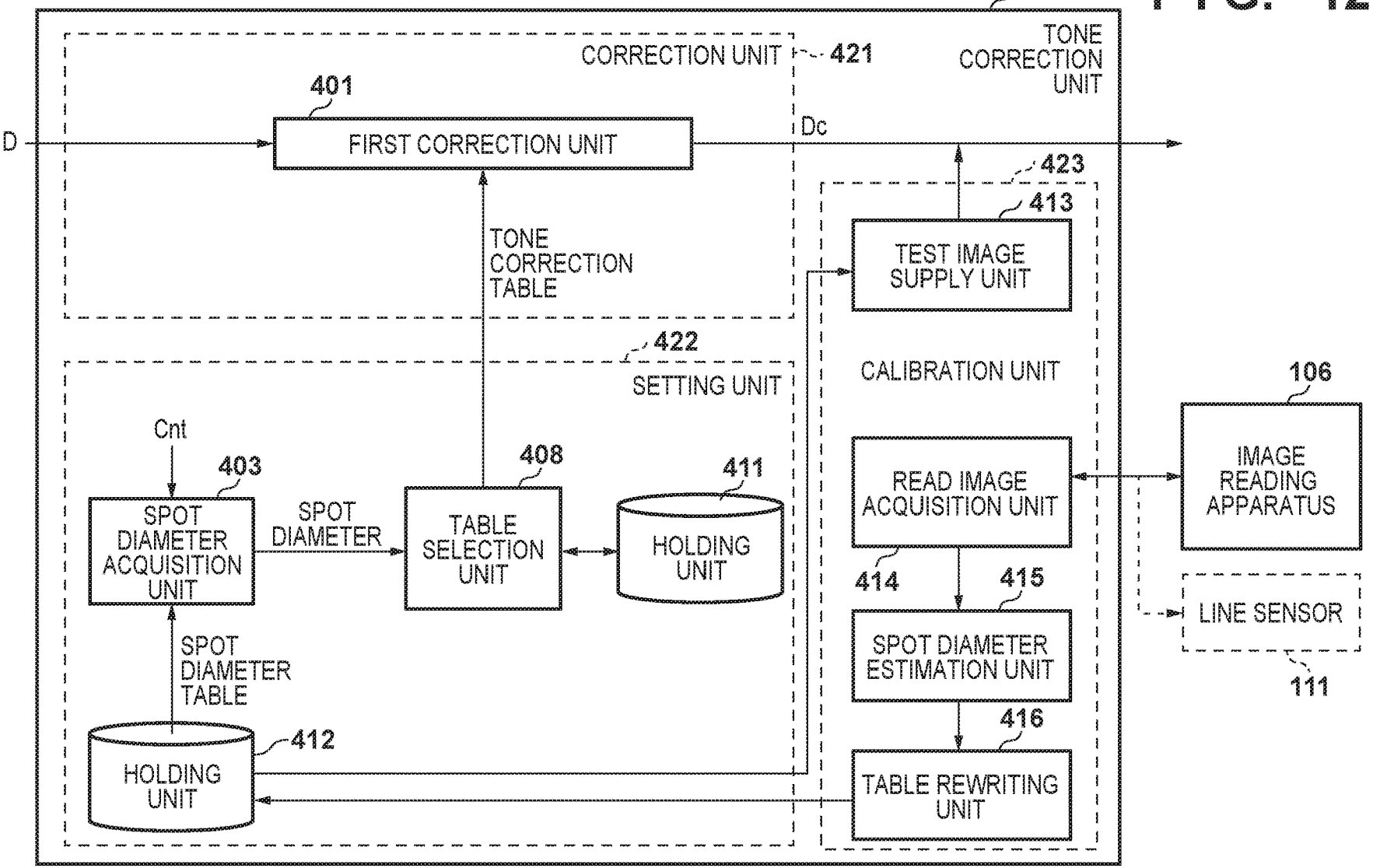
FIG. 12 is a view illustrating an example configuration of an image processor unit of a third embodiment.

FIG. 12 illustrates an example configuration of the tone correction unit 304 of the third embodiment. For simplicity FIG. 12 illustrates a configuration in which a calibration unit 423 for a spot diameter table is added to the configuration of the tone correction unit 304 of the second embodiment, but a configuration in which the calibration unit 423 is added to the configuration of the tone correction unit 304 of the first embodiment is also possible. A test image supply unit 413 inputs to the image forming controller 103 pixel data of a test image read from the holding unit 412. Note that the image data of the test image may be input from an external unit. An image forming unit 105*a*, which is input with a drive signal for the test image from the image forming controller 103, forms the test image by a process that is similar to normal image formation.

A read image acquisition unit 414 controls an image reading apparatus 106 via a USB interface or the like for example, and acquires image data generated by the image reading apparatus 106 reading the test image. The image reading apparatus 106 is, for example, an image reader of the image forming apparatus 101, an external image scanner, or the like. A spot diameter estimation unit 415 estimates the spot diameter for a plurality of positions on the photoreceptor 151, based on the image data of the test image. A table rewriting unit 416 rewrites the spot diameter tables held by the holding unit 412 based on the estimated spot diameters.

The calibration unit 423 is realized by, for example, a one-chip microcontroller (MPU) executing a program for calibration stored in an integrated ROM. Alternatively, it may be realized by a CPU of a control unit (not shown) of the image processing unit 103*a* or the image forming apparatus 101 executing a program for calibration stored in a ROM or the like.

Test Image

FIGS. 13A-13F are views illustrating examples of test images. FIG. 13A illustrates an entirety of a test image stored in the holding unit 412, and FIGS. 13B and 13C illustrate spot diameter patches. As illustrated in FIG. 13A, a spot diameter patch is consecutively formed across an effective main scanning range of the photoreceptor 151 by the test image, and a black reference patch 1301 and a white reference patch 1302 are formed. For example, in a case of calibrating the spot diameter table illustrated in FIG. 6, 256 spot diameter patches are consecutively formed in one line. As illustrated in FIGS. 13B and 13C, position reference images 1303*a* and 1303*b*—or position reference images 1303*c* and 1303*d* for an end—are arranged for a spot diameter patch. For a position reference image, there are two markers of a cross-shape or a T-shape (for an end) for example, and the two markers are arranged at the same main scanning position, and a spot diameter patch is present on a line segment that connects the two markers.

FIG. 13D illustrated an example of a test image formed on a print paper. If the spot diameter is large, then toner adheres to a wider region, the area of a spot diameter patch becomes larger, and a spot diameter patch illustrated in FIG. 13F (hereinafter, a large-diameter patch) as an example is formed. However, if the spot diameter is small, then toner adheres to a smaller region, the area of a spot diameter patch does not becomes larger, and a spot diameter patch illustrated in FIG. 13E (hereinafter, a small-diameter patch) as an example is formed. Note that there is actually form distortion or shading due to unevenness of a toner apply amount, but FIGS. 13D, 13E, and 13F ignore these to illustrate a simplified state.

As illustrated in FIGS. 13E and 13F, a patch width 1305 having a large-diameter patch is larger than a patch width 1304 of a small-diameter patch. As illustrated in FIG. 13D, in a case where the spot diameter is small in a central portion of the photoreceptor 151 and the spot diameter is large in an end portion of the photoreceptor 151, for example a small-diameter patch (FIG. 13E) can be obtained at the central portion and a large-diameter patch (FIG. 13F) can be obtained at an end portion. In this way, a correlation between spot diameter and patch width can be obtained. Accordingly, in the third embodiment, spot diameter patches are formed at a plurality of positions of the effective main scanning range of the photoreceptor 151, and the patch widths are measured to estimate the spot diameters for the plurality of positions.

Calibration

Calibration of a spot diameter table is performed at a predetermined timing after activation of the image forming apparatus 101, each predetermined interval, or each predetermined operation time of the image forming unit 150*a*, or performed in accordance with a user instruction. Alternatively, it is also possible to perform calibration of the spot diameter table if, at a predetermined timing after activation of the image forming apparatus 101, a measurement chart for inplane unevenness is formed and inplane unevenness measured in accordance with the measurement chart exceeds a predetermined size.

Figure 14:
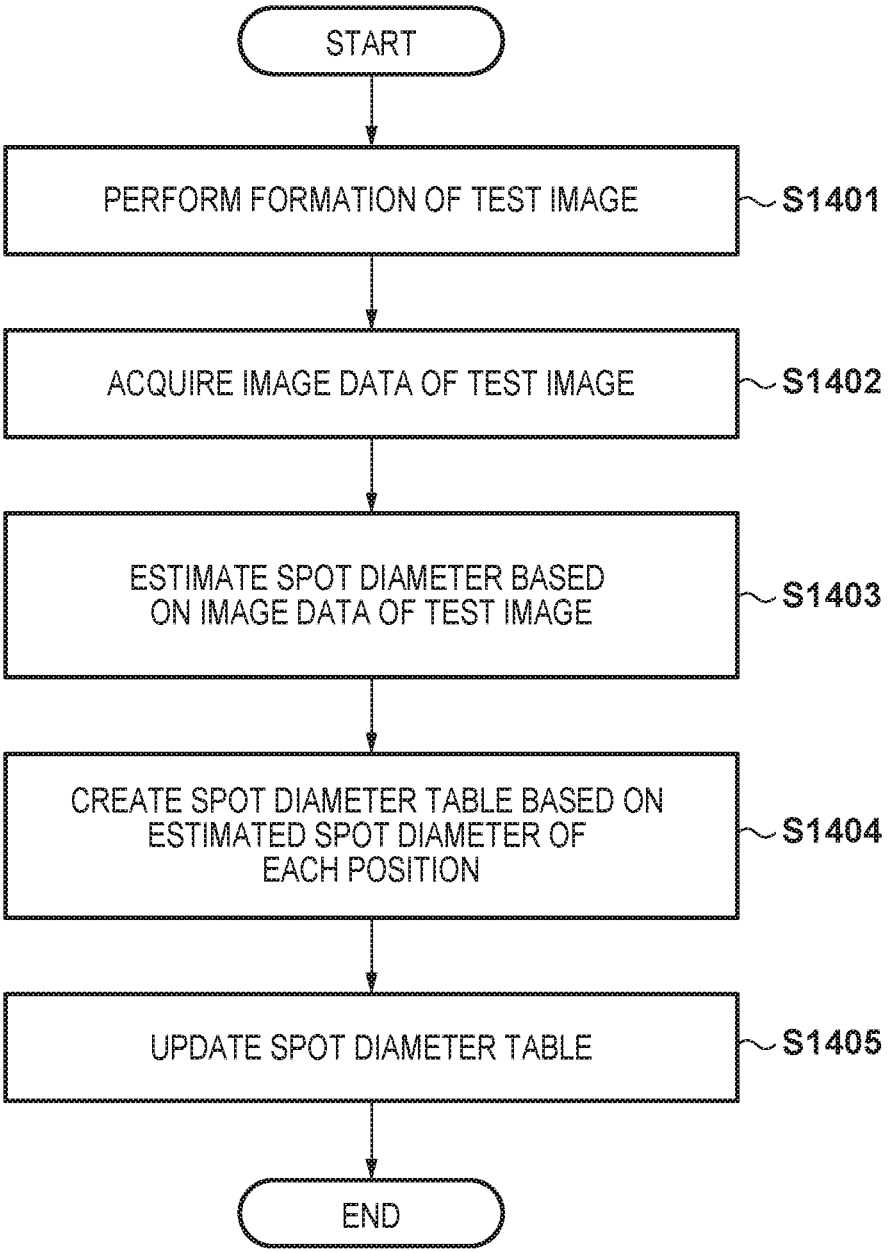
FIG. 14 is a flowchart for describing processing of a calibration unit.

Description is given of processing of the calibration unit 423 in accordance with the flowchart of FIG. 14. This processing is performed approximately simultaneously, or successively to each color of YMCK. The test image supply unit 413 supplies the image forming controller 103 with pixel data of a test image read from the holding unit 412, and performs formation of the test image (step S1401). After forming the test image, the read image acquisition unit 414 acquires image data for the test image from the image reading apparatus 106 (step S1402). Details are described later, but the spot diameter estimation unit 415 estimates spot diameters based on the image data of the test image (step S1403). The table rewriting unit 416 creates a spot diameter table based on estimated spot diameters of each position (step S1404), and updates the spot diameter table held by the holding unit 412 (step S1405).

Figure 15:
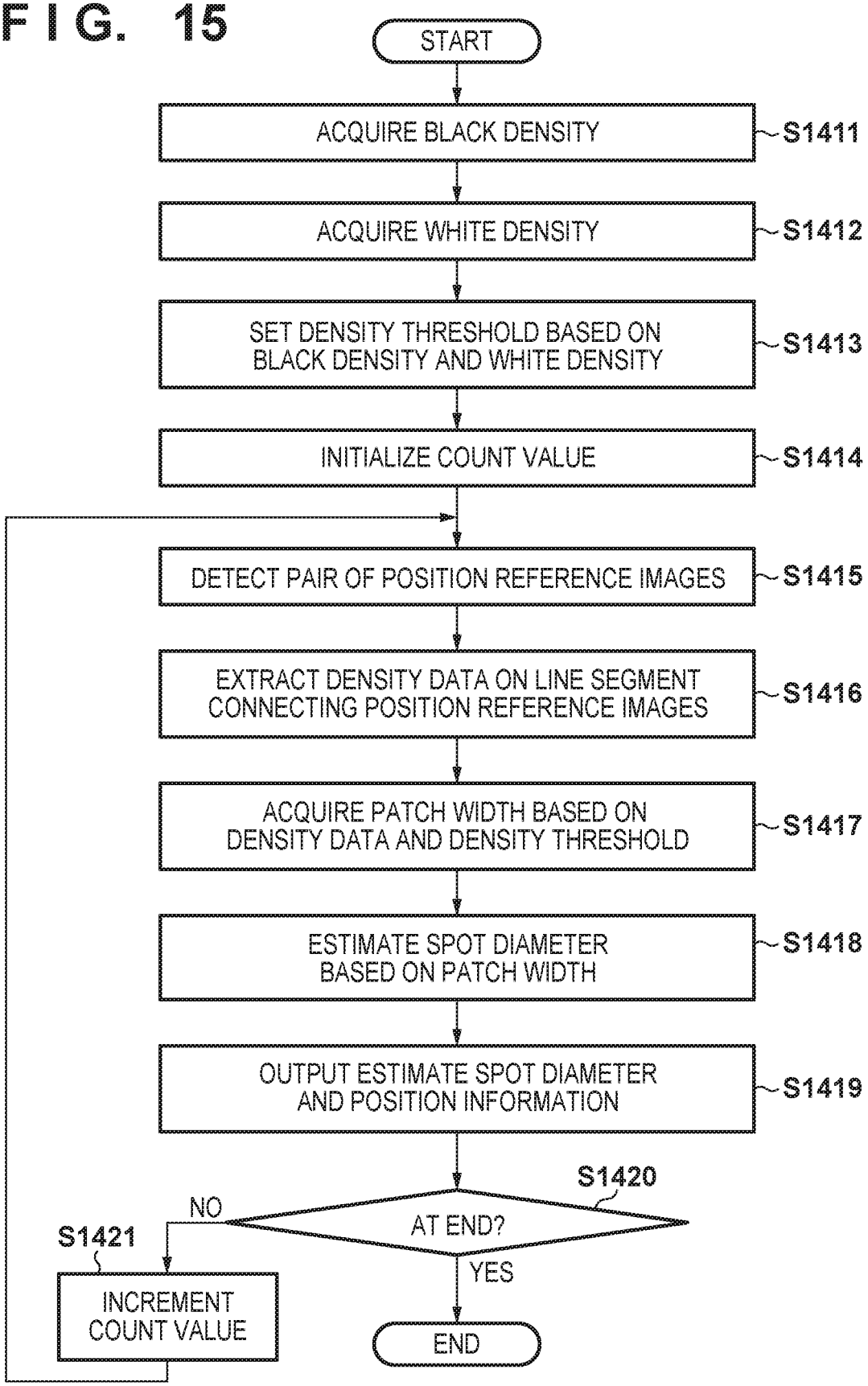
FIG. 15 is a flowchart for describing estimation of a spot diameter.

Estimation of a spot diameter (step S1403) is described in accordance with the flowchart of FIG. 15. The spot diameter estimation unit 415 acquires a black density (step S1411), and acquires a white density (step S1412). An average value of densities of the black reference patch image included in the image data of the test image is acquired as the black density, and an average value of densities of the white reference patch image included in the image data of the test image is acquired as the white density. Next, the spot diameter estimation unit 415 sets a density threshold based on the acquired black density and white density (for example, an average value of the black density and the white density) (step S1413), and initializes a count value to "0" (step S1414).

Next, the spot diameter estimation unit 415 detects a pair of position reference images from the image data of the test image (step S1415). Note that the position reference image detected first corresponds to the left side of the effective main scanning range of the photoreceptor 151. Next, the spot diameter estimation unit 415 extracts density data that is on a line segment connecting the detected position reference images (step S1416), and acquires a length of a line segment for which the density data is greater than or equal to the density threshold as a patch width (step S1417).

Figure 16A:
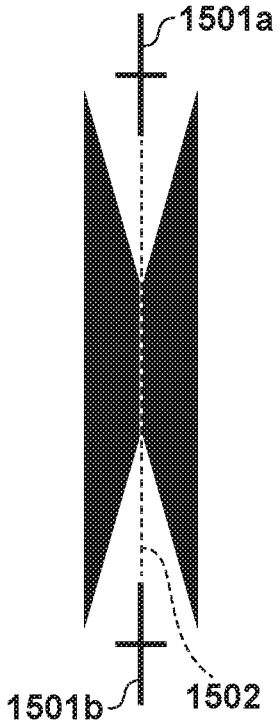
FIGS. 16A and 16B are views illustrating a relation between a line segment, density data, and a patch width.
Figure 16B:
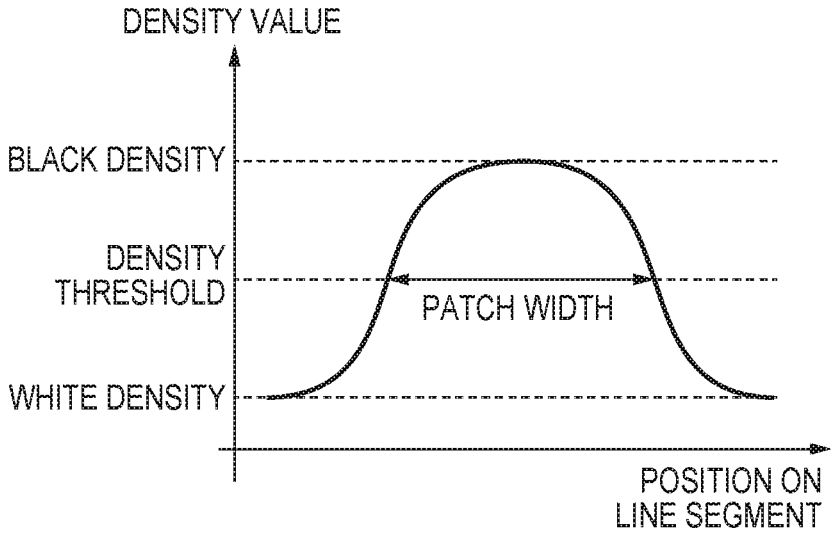

A relation between a line segment, density data, and patch width is illustrated by FIGS. 16A and 16B. As illustrated in FIG. 16A, density data for a line segment 1502 connecting position reference images 1501*a* and 1501*b* is acquired. The density data indicates a density change in a sub scanning direction of the spot diameter patch. As illustrated in FIG. 16B, the length of a line segment for which the density data is greater than or equal to the density threshold is acquired as a patch width.

Next, the spot diameter estimation unit 415 estimates a spot diameter based on the acquired patch width (step S1418), and outputs the estimated spot diameter and position information to the table rewriting unit 416 (step S1419). The spot diameter is estimated by, for example, creating in advance and storing a table that represents a relation between patch width and spot diameter, and referring to the table. Of course, configuration may be taken to calculate the spot diameter from the patch width by using a function. In addition, if the spot diameter table has the format of FIG. 6, the position information becomes a value achieved after subtracting the count value from 128.

Next, the spot diameter estimation unit 415 determines whether estimation of the spot diameter has reached the end based on the position reference image detected in step S1415 (step S1420). In other words, if the position reference images correspond to an end position reference (FIG. 13C), the spot diameter estimation unit 415 terminates estimation of the spot diameter. If that is not the case, the spot diameter estimation unit 415 increments the count value (step S1421), and returns the processing to step S1415.

As exemplified in FIG. 13C, because a position reference is a T-shape only at an end and is a cross-shape otherwise, it is possible to easily determine the end of the estimation processing from differences in shape of a position reference image. The shape of a position reference is not limited to this, and may be any shape if it is possible to determine the position reference of an end.

Alternatively, configuration may be taken to determine whether the end has been reached based on the count value. Alternatively, in detection of a second position reference image onward (step S1415), a position reference image positioned neighboring to the right of a position reference image detected previously is detected.

In this way, a test image in which spot diameter patches are consecutively arranged across the effective main scanning range of the photoreceptor 151 is formed, and calibration of a spot diameter table based on image data read from the test image is possible. Therefore, it is possible to support change of a spot diameter generated by thermal deformation, temporal change, or the like at an appropriate timing, and it is possible to allow maintenance of precision of inplane uneven density correction by the spot diameter based tone correction method.

[First Variation]

In the third embodiment, description is given of an example in which a test image is formed on a print paper by a process the same as normal image formation, and image data of the test image which is read by an external image reading apparatus 106 or the like is used in calibration. It is also possible to, by a sensor arranged near the intermediate transfer belt 110 (for example a line sensor 111 illustrated in FIG. 12), read a test image formed on the intermediate transfer belt 110, and use the image data thereof in calibration.

Figure 17:
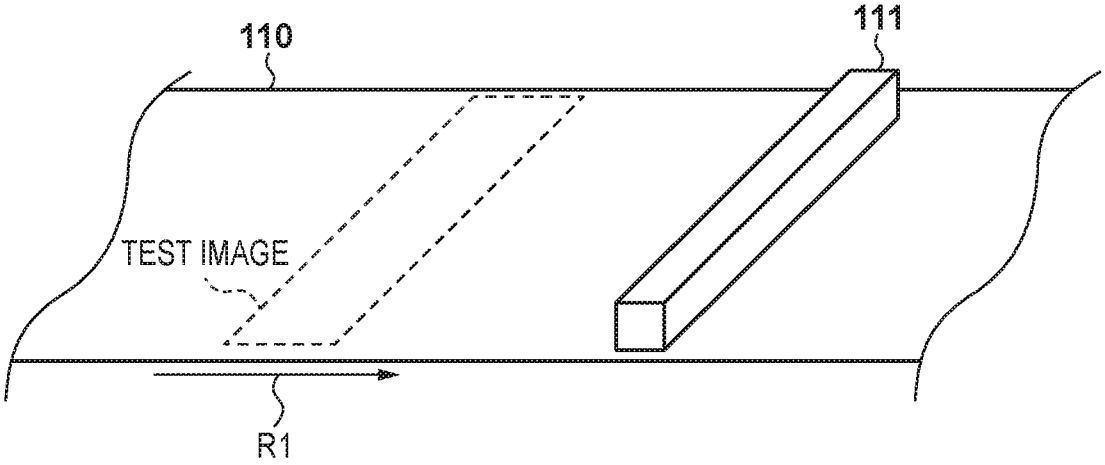
FIG. 17 is a view illustrating an example of a relation between a line sensor and an intermediate transfer belt in a first variation.

FIG. 17 is a view illustrating an example of a relation between the line sensor 111 and the intermediate transfer belt 110 in a first variation. The line sensor 111 is positioned on a downstream side of the image forming unit 150*d* in a movement direction of the intermediate transfer belt 110, and measures density of a test image (a toner image) on the intermediate transfer belt 110 by a plurality of sensors arranged in the main scanning direction. Note that if it is a physical amount corresponding to density, a brightness or a luminance may be measured, for example. In addition, a secondary transfer and fixing do not need to be performed in formation processing of the test image in this case.

For example, in a case of calibrating the spot diameter table illustrated in FIG. 6, it is sufficient to use a line sensor 111 that has at least 256 light receiving elements. In a case of using the line sensor 111 which has 256 or more light receiving elements, it is sufficient if an average value of density data of a plurality of neighboring light receiving elements is used. The read image acquisition unit 414 successively acquires the density data from the line sensor 111, stores the density data in a buffer, and forms the image data of the test image. The spot diameter estimation unit 415 estimates the spot diameter for each light receiving element of the line sensor 111, based on the image data of the test image.

Figure 18:
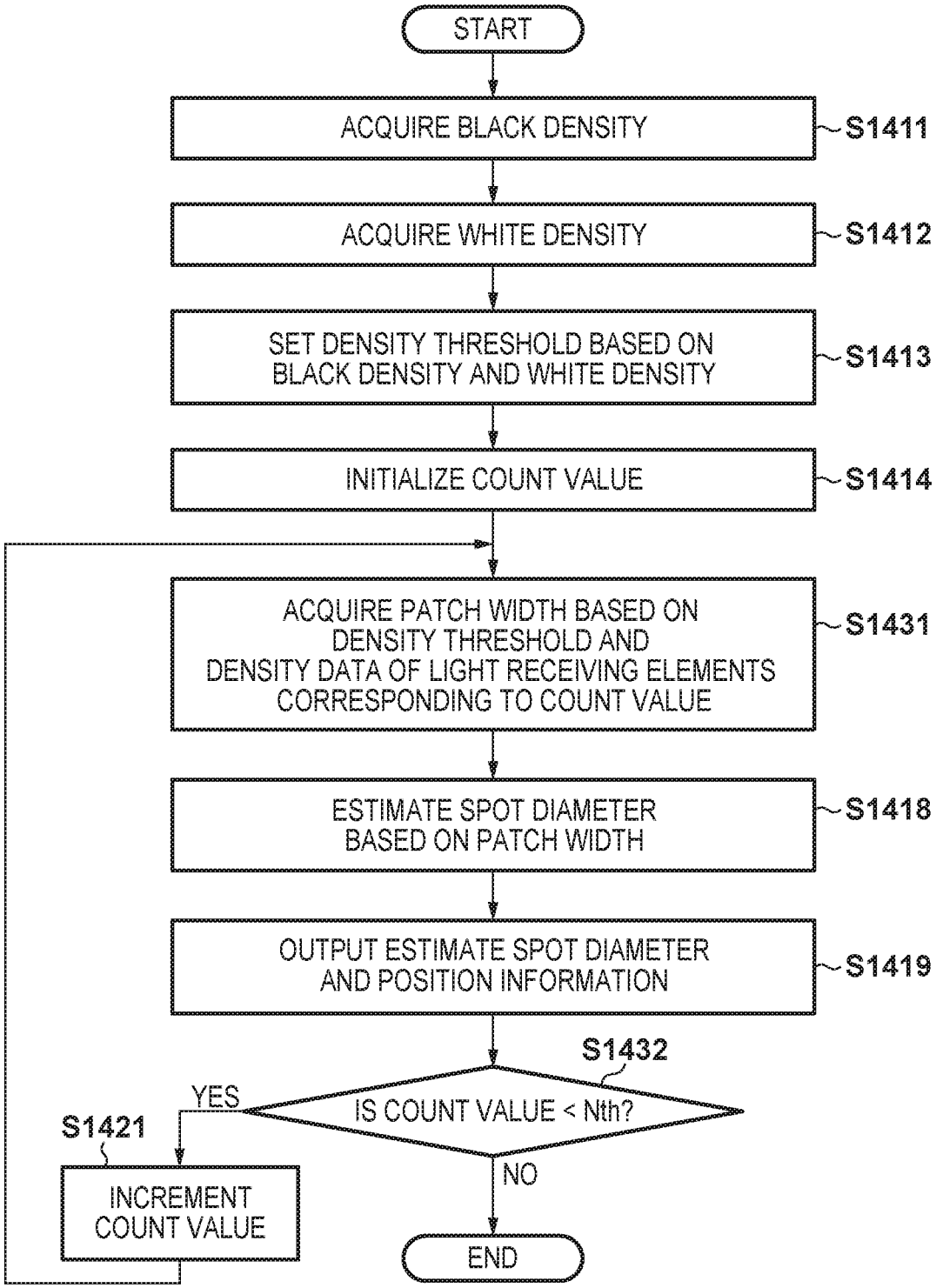
FIG. 18 is a flowchart for describing estimation of a spot diameter according to the first variation.

Estimation of a spot diameter (step S1403) in the first variation is described in accordance with the flowchart of FIG. 18. Processing that is the same as processing illustrated in FIG. 15 has the same reference numeral added, and a detailed description thereof is omitted. After initializing the count value to "0" (step S1414), the spot diameter estimation unit 415 acquires the patch width based on the density threshold and the density data of light receiving elements corresponding to the count value (step S1431). In other words, change of the density data of the corresponding light receiving elements is examined, and a segment (a number of pixels) for which the density data is greater than or equal to the density threshold is acquired as the patch width.

Next, the spot diameter estimation unit 415 performs estimation of the spot diameter (step S1418) and output of the spot diameter and position information (step S1419), and determines whether the count value is less that a threshold Nth (step S1432). The threshold Nth is "256" in the case of a spot diameter table having the format of FIG. 6. If the count value is less than the threshold Nth, the processing returns to step S1431 after achieving an increment of the count value (step S1421). When the count value reaches the threshold Nth, the spot diameter estimation unit 415 terminates estimation of the spot diameter.

Although description was given above of an example of arranging the line sensor 111 near the intermediate transfer belt 110, arrangement of the line sensor 111 is not limited to this. For example, the line sensor 111 may be arranged near the photoreceptor 151, or the line sensor 111 may be arranged at a position for reading an image on the print paper before it is discharged outside of the image forming apparatus 101.

[Second Variation]

Description is given below of calibration that uses a test image different to the test image illustrated in FIG. 13A. FIGS. 19A-19F illustrate an example of a test image of a second variation. Unlike the spot diameter patch in the test image illustrated in FIG. 13A which is a spool shape (hereinafter, a spool type test image), the spot diameter patch of the test image of the second variation has a pattern in which white portions and black portions are alternatingly arranged in a sub scanning direction. The test image of the second variation is called a "striped test image" below.

Figure 19A:
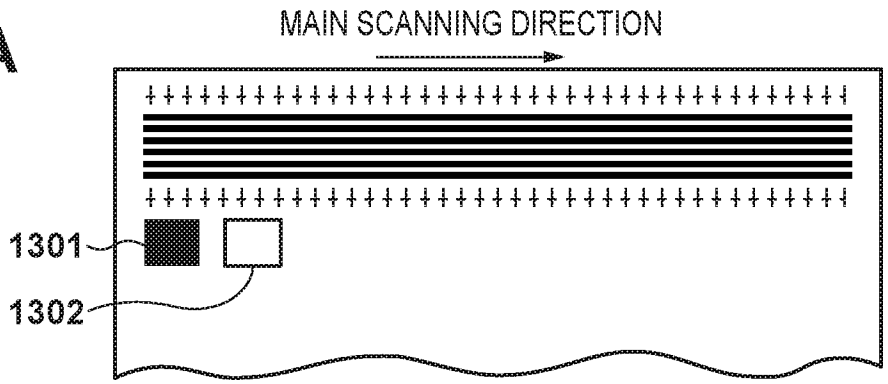
FIGS. 19A-19F are views illustrating examples of test images of a second variation.
Figure 19B:
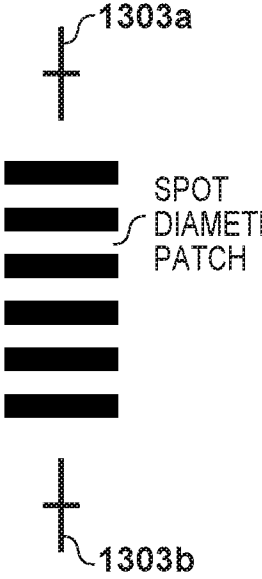
Figure 19C:
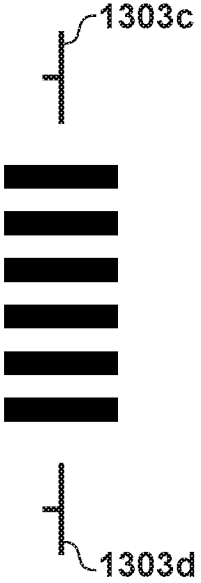

FIG. 19A illustrates an entirety of a test image stored in the holding unit 412, and FIGS. 19B and 19C illustrate spot diameter patches. As illustrated in FIG. 19A, a spot diameter patch is consecutively formed across an effective main scanning range of the photoreceptor 151 by the test image, and the black reference patch 1301 and the white reference patch 1302 are formed. For example, in a case of calibrating the spot diameter table illustrated in FIG. 6, 256 spot diameter patches are consecutively formed in one line.

As illustrated in FIGS. 19B and 19C, position reference images 1303*a* and 1303*b*—or position reference images 1303*c* and 1303*d* for an end—are arranged for a spot diameter patch. For a position reference image, there are two markers of a cross-shape or a T-shape (for an end) for example, and the two markers are arranged at the same main scanning position, and a spot diameter patch is present on a line segment that connects the two markers.

Figure 19D:
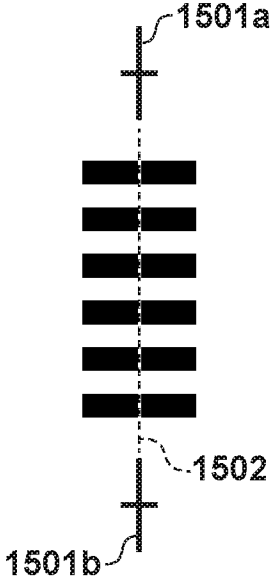
Figure 19E:
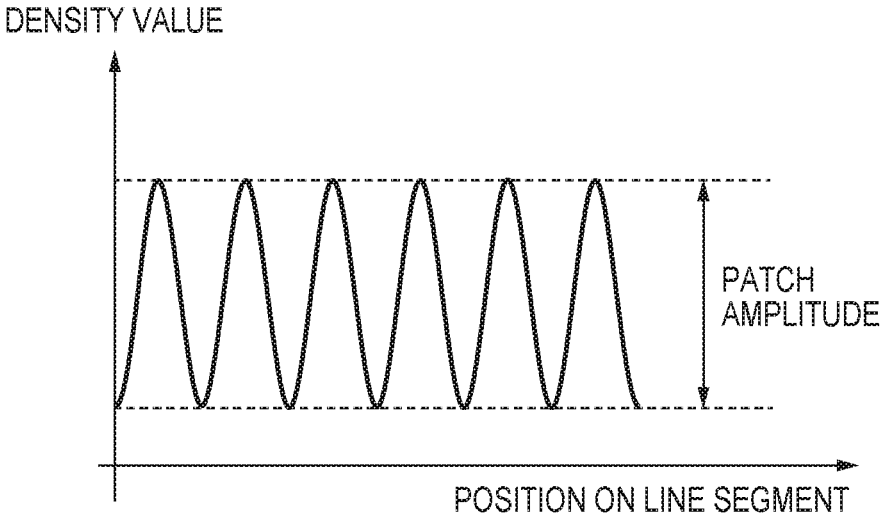
Figure 19F:
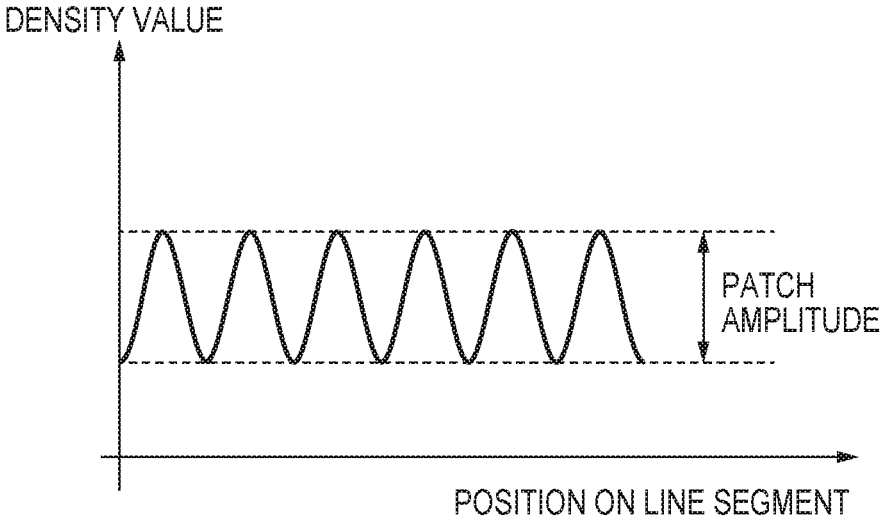

FIG. 19D illustrates an example of a spot diameter patch formed on a print paper, and density data of the line segment 1502 that connects the position reference images 1501*a* and 1501*b* is acquired. FIG. 19E illustrates change of the density data of the line segment 1502 (hereinafter, a patch amplitude) when the spot diameter is small, where a patch amplitude is large. Meanwhile FIG. 19F illustrates a patch amplitude for a case where the spot diameter is large, and the patch amplitude is small. In the second variation, this property is used to estimate the spot diameter.

Figure 20:
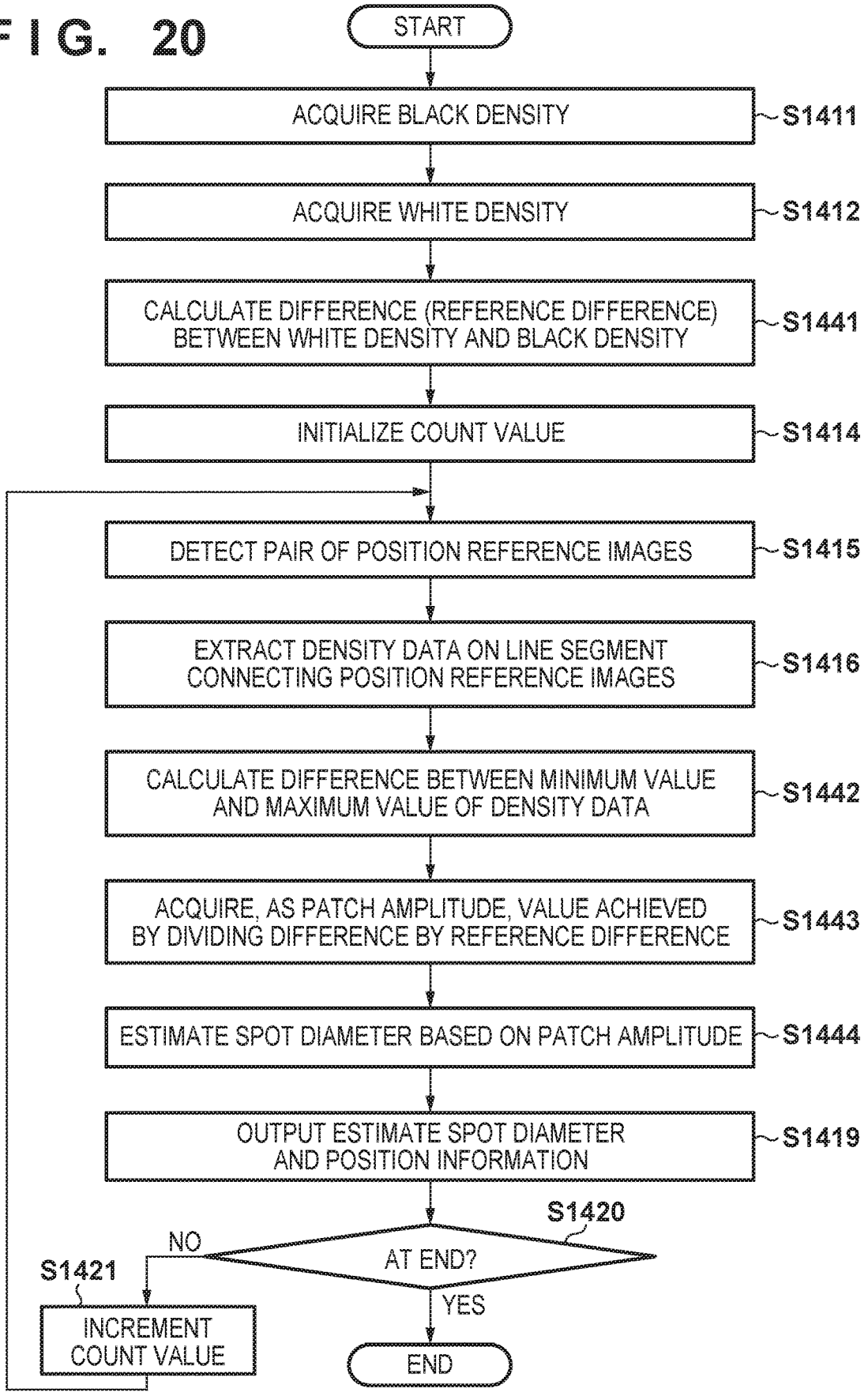
FIG. 20 is a flowchart for describing estimation of a spot diameter according to the second variation.

Estimation of a spot diameter (step S1403) in the second variation is described in accordance with the flowchart of FIG. 20. Processing that is the same as processing illustrated in FIG. 15 has the same reference numeral added, and a detailed description thereof is omitted. The spot diameter estimation unit 415 acquires the black density (step S1411), acquires the white density (step S1412), and calculates the difference between the black density and the white density (hereinafter, a reference difference) (step S1441).

Next, the spot diameter estimation unit 415 initializes the count value to "0" (step S1414), detects a pair of position reference images (step S1415), and extracts density data on a line segment connecting the position reference images (step S1416). A difference between a maximum value and a minimum value of the density data is calculated (step S1442). At that time, it is desirable to calculate a difference between an average value of a plurality of maximum values and an average value of a plurality of minimum values. Next, the spot diameter estimation unit 415 acquires as the patch amplitude a value achieved by dividing the difference calculated in step S1442 by the reference difference (step S1443), and estimates the spot diameter based on the acquired patch amplitude (step S1444). The spot diameter is estimated by, for example, creating in advance and storing a table that represents a relation between patch amplitude and spot diameter, and referring to the table. Output of the spot diameter and position information (step S1419), determination of the end (step S1420), and incrementing of the count value (step S1421) are similar to in the third embodiment, and description thereof is omitted.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-224234, filed Nov. 16, 2015, which is hereby incorporated by reference herein in its entirety.

What is claimed is:

1. An image processing apparatus comprising:

a holding unit configured to hold a plurality of tone correction properties corresponding to spot diameters of light exposed on a photoreceptor;

an acquisition unit configured to acquire a formation position on the photoreceptor;

a setting unit configured to set, based on the acquired formation position, at least one tone correction property out of the plurality of tone correction properties held in the holding unit;

a correction unit configured to perform correction processing on a pixel data for the formation position based on the set at least one tone correction property to generate tone correction data; and an image forming unit configured to perform image formation based on the tone correction data generated by the correction unit;

wherein, in a case where the spot diameter corresponding to the formation position matches with the spot diameter corresponding to the set at least one tone correction property, the setting unit sets one tone correction property, while, in a case where the spot diameter corresponding to the formation position does not match with the spot diameter corresponding to the set at least one tone correction property, the setting unit sets two or more tone correction properties.

2. The image processing apparatus according to claim 1, wherein the acquisition unit acquires the formation position with the spot diameter based on the spot diameter table, and the setting sets the tone correction property out of the plurality of tone correction properties based on the acquired spot diameter.

3. The image processing apparatus according to claim 1, wherein the acquisition unit acquires the formation position with the spot diameter based on the spot diameter table, and the setting unit selects two set tone correction properties corresponding to two spot diameters sandwiching the acquired spot diameter, from the plurality of tone correction properties; and the correction unit further calculates a ratio based on the spot diameters that the two tone correction properties correspond to.

4. The image processing apparatus according to claim 3, wherein the correction unit generates first correction data that corrects the pixel data based on one of the two set tone correction properties, generates second correction data that corrects the pixel data based on the other of the two set tone correction properties, and generates the tone correction data by blending the first and second correction data based on the ratio.

5. The image processing apparatus according to claim 1, wherein the setting unit sets the tone correction property based on a spot diameter at a formation position on the photoreceptor for the pixel corresponding to the pixel data.

6. The image processing apparatus according to claim 2, further comprising a generation unit configured to generate, based on the tone correction data, a drive signal for a light-emitting element for emitting light for irradiating the photoreceptor, wherein the drive signal is output to the image forming unit, wherein the generation unit is performed by a processor which executes a program stored in a memory.

7. A method for controlling an image processing apparatus, the method comprising:

holding a plurality of tone correction properties corresponding to spot diameters of light exposed on a photoreceptor;

acquiring a formation position on the photoreceptor;

setting, based on the acquired formation position, at least one tone correction property out of the plurality of tone correction properties held in the holding;

performing correction processing on a pixel data for the formation position based on the set at least one tone correction property to generate tone correction data; and performing image formation based on the generated tone correction data, wherein, in a case where the spot diameter corresponding to the formation position matches with the spot diameter corresponding to the set at least one tone correction property, one tone correction property is set in the setting, while, in a case where the spot diameter corresponding to the formation position does not match with the spot diameter corresponding to the set at least one tone correction property, two or more tone correction properties are set in the setting.

8. A non-transitory computer-readable storage medium storing a program which causes a computer to execute steps of a method for controlling an image processing apparatus, the method comprising:

holding a plurality of tone correction properties corresponding to spot diameters of light exposed on a photoreceptor;

acquiring a formation position on the photoreceptor;

setting based on the acquired formation position, at least one tone correction property out of the plurality of tone correction properties held in the holding;

performing correction processing on a pixel data for the formation position based on the set at least one tone correction property to generate tone correction data; and performing image formation based on the generated tone correction data, wherein, in a case where the spot diameter corresponding to the formation position matches with the spot diameter corresponding to the set at least one tone correction property, one tone correction property is set in the setting, while, in a case where the spot diameter corresponding to the formation position does not match with the spot diameter corresponding to the set at least one tone correction property, two or more tone correction properties are set in the setting.

9. The image processing apparatus according to claim 1, wherein, in a case where the spot diameter of the formation position matches with a spot diameter corresponding the at least one tone correction property, the correction unit performs the correction processing based on the tone correction property and a tone value represented by the pixel data.

10. The image processing apparatus according to claim 1, wherein, in a case where the spot diameter of the formation position does not match with a spot diameter corresponding the at least one tone correction property, the correction unit performs the correction processing based on a ratio of the spot diameter of the formation position and the spot diameter corresponding to the tone correction property.

11. The image processing apparatus according to claim 1, wherein the setting unit sets a first tone correction property of the plurality of tone correction properties to a plurality of formation positions on the photoreceptor, wherein the correction unit performs, on each of the plurality of formation positions at which the first tone correction property is referred, the correction processing in accordance with the spot diameter corresponding to each of the plurality of formation positions.

12. The image processing apparatus according to claim 1, wherein the correction processing is depend upon the combination of the spot diameter of the formation position on the photoreceptor and the spot diameter corresponding to the at least one tone correction property.

* * * * *